US011645893B2

(12) United States Patent
Dillon

(10) Patent No.: US 11,645,893 B2
(45) Date of Patent: May 9, 2023

(54) SYSTEMS AND METHODS FOR FACILITATING BETTING IN A GAME

(71) Applicant: Tim Dillon, Bellevue, WA (US)

(72) Inventor: Tim Dillon, Bellevue, WA (US)

( * ) Notice: Subject to any disclaimer, the term of this patent is extended or adjusted under 35 U.S.C. 154(b) by 0 days.

(21) Appl. No.: 16/688,001

(22) Filed: Nov. 19, 2019

(65) Prior Publication Data

US 2021/0065517 A1 Mar. 4, 2021

Related U.S. Application Data

(60) Provisional application No. 62/895,377, filed on Sep. 3, 2019.

(51) Int. Cl.
*G07F 17/32* (2006.01)

(52) U.S. Cl.
CPC ..... *G07F 17/3288* (2013.01); *G07F 17/3223* (2013.01); *G07F 17/3251* (2013.01)

(58) Field of Classification Search
CPC ..... G07F 17/3288; G07F 17/3223; G07F 17/3251
See application file for complete search history.

(56) References Cited

U.S. PATENT DOCUMENTS

RE33,559 E * 3/1991 Fallacaro ..... A63F 13/005 386/201
6,434,398 B1 * 8/2002 Inselberg ..... G06Q 30/0242 455/517
6,760,595 B2 * 7/2004 Inselberg ..... A63F 13/12 455/517
6,840,861 B2 * 1/2005 Jordan ..... A63F 13/12 463/42
8,342,946 B2 * 1/2013 Amaitis ..... G06F 17/40 463/25
9,033,781 B2 5/2015 Steir et al.
2003/0157976 A1 * 8/2003 Simon ..... G07F 17/3244 463/1
2006/0094506 A1 * 5/2006 Tarter ..... G06Q 10/00 463/42
2012/0191230 A1 * 7/2012 Hopf ..... G07F 17/3244 700/92

(Continued)

FOREIGN PATENT DOCUMENTS

KR 20020013953 A 2/2002

*Primary Examiner* — James S. McClellan
*Assistant Examiner* — Ross A Williams

(57) ABSTRACT

Disclosed herein is a method to facilitate betting in a game. Accordingly, the method may include a step of receiving a game data from a game sensor. Further, the method may include a step of analyzing the game data. Further, the method may include a step of identifying an occurrence of a betting event. Further, the method may include a step of transmitting options. Further, the method may include a step of receiving an option indication. Further, the method may include a step of receiving an actual outcome of the betting event from the game sensor. Further, the method may include a step of comparing the option indication and the actual outcome. Further, the method may include a step of determining a response. Further, the method may include a step of transmitting the response to the participant device. Further, the method may include a step of storing the response.

14 Claims, 37 Drawing Sheets

(56) References Cited

U.S. PATENT DOCUMENTS

| | | | | |
|---|---|---|---|---|
| 2012/0264504 | A1* | 10/2012 | Gagner | G07F 17/326 463/25 |
| 2013/0184039 | A1* | 7/2013 | Steir | A63F 13/828 463/1 |
| 2013/0231999 | A1* | 9/2013 | Emrich | G06Q 30/0271 705/14.43 |
| 2014/0018156 | A1 | 1/2014 | Rizzotti | |
| 2015/0024814 | A1 | 1/2015 | Root | |
| 2018/0178128 | A1* | 6/2018 | Onda | A63F 13/79 |
| 2019/0244485 | A1* | 8/2019 | Jones | G07F 17/3279 |
| 2019/0355204 | A1* | 11/2019 | Edgar | G06Q 20/28 |
| 2019/0392684 | A1* | 12/2019 | McDonald | G06Q 50/34 |
| 2020/0111325 | A1* | 4/2020 | Lockton | G07F 17/3288 |

* cited by examiner

1500

1800

2000

Signin

2400

3300

Login

3500

SYSTEMS AND METHODS FOR FACILITATING BETTING IN A GAME

The current application claims a priority to the U.S. Provisional Patent application Ser. No. 62/895,377 filed on Sep. 3, 2019.

TECHNICAL FIELD

Generally, the present disclosure relates to the field of data processing. More specifically, the present disclosure relates to systems and methods for facilitating betting in a game.

BACKGROUND

Live events such as live games may have vast popularity. Further, the popularity of a live game may be enhanced by letting fans participate in live games. Further, there may be a need for systems that may allow the fans to participate in the live games. Further, the participation of the fans may enhance the relationship that the fans may share with the live games. Further, there may be a need for systems that facilitate the fans to participate in the live game that may allow the fans to earn rewards with no risks.

Therefore, there is a need for improved methods and systems to facilitate participating in the gameplay of a game that may overcome one or more of the above-mentioned problems and/or limitations.

BRIEF SUMMARY

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a system for facilitating betting in a game, in accordance with some embodiments. Accordingly, the system may include a communication device, a processing device, and a storage device. Further, the communication device may be configured for receiving game data associated with at least one game from at least one game sensor. Further, the at least one game sensor may be configured to generate the game data. Further, the communication device may be configured for transmitting a plurality of options associated with an outcome of a betting event to at least one participant device associated with at least one participant. Further, the communication device may be configured for receiving an option indication corresponding an option of the plurality of options from the at least one participant device. Further, the communication device may be configured for receiving an actual outcome of the betting event from the at least one game sensor. Further, the communication device may be configured for transmitting at least one response to the at least one participant device. Further, the processing device may be configured for analyzing the game data. Further, the processing device may be configured for identifying an occurrence of the betting event based on the analyzing. Further, the processing device may be configured for comparing the option indication and the actual outcome. Further, the processing device may be configured for determining the at least one response based on the comparing. Further, the storage device may be configured for storing the at least response corresponding to the betting event and the betting event in a database.

Further, disclosed herein is a method for facilitating betting in a game, in accordance with some embodiments. Accordingly, the method may include a step of receiving, using a communication device, game data associated with at least one game from at least one game sensor. Further, the at least one game sensor may be configured to generate the game data. Further, the method may include a step of analyzing, using a processing device, the game data. Further, the method may include a step of identifying, using the processing device, an occurrence of a betting event based on the analyzing. Further, the method may include a step of transmitting, using the communication device, a plurality of options associated with an outcome of the betting event to at least one participant device associated with at least one participant. Further, the method may include a step of receiving, using the communication device, an option indication corresponding an option of the plurality of options from the at least one participant device. Further, the method may include a step of receiving, using the communication device, an actual outcome of the betting event from the at least one game sensor. Further, the method may include a step of comparing, using the processing device, the option indication and the actual outcome. Further, the method may include a step of determining, using the processing device, at least one response based on the comparing. Further, the method may include a step of transmitting, using the communication device, the at least one response to the at least one participant device. Further, the method may include a step of storing, using a storage device, the at least response corresponding to the betting event and the betting event in a database.

Further, disclosed herein is a method for facilitating betting in a game, in accordance with some embodiments. Accordingly, the method may include a step of receiving, using a communication device, game data associated with at least one play by play game from at least one game sensor. Further, the at least one game sensor may be configured to generate the game data. Further, the at least one play by play game may include a plurality of betting events. Further, the method may include a step of analyzing, using a processing device, the game data. Further, the method may include a step of identifying, using the processing device, an occurrence of a betting event based on the analyzing. Further, the method may include a step of transmitting, using the communication device, a plurality of options associated with an outcome of the betting event to at least one participant device associated with at least one participant. Further, the method may include a step of receiving, using the communication device, an option indication corresponding an option of the plurality of options from the at least one participant device. Further, the method may include a step of receiving, using the communication device, an actual outcome of the betting event from the at least one game sensor. Further, the method may include a step of comparing, using the processing device, the option indication and the actual outcome. Further, the method may include a step of determining, using the processing device, at least one response based on the comparing. Further, the method may include a step of transmitting, using the communication device, the at least one response to the at least one participant device. Further, the method may include a step of storing, using a storage device, the at least response corresponding to the betting event and the betting event in a database.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION

Figure 1:
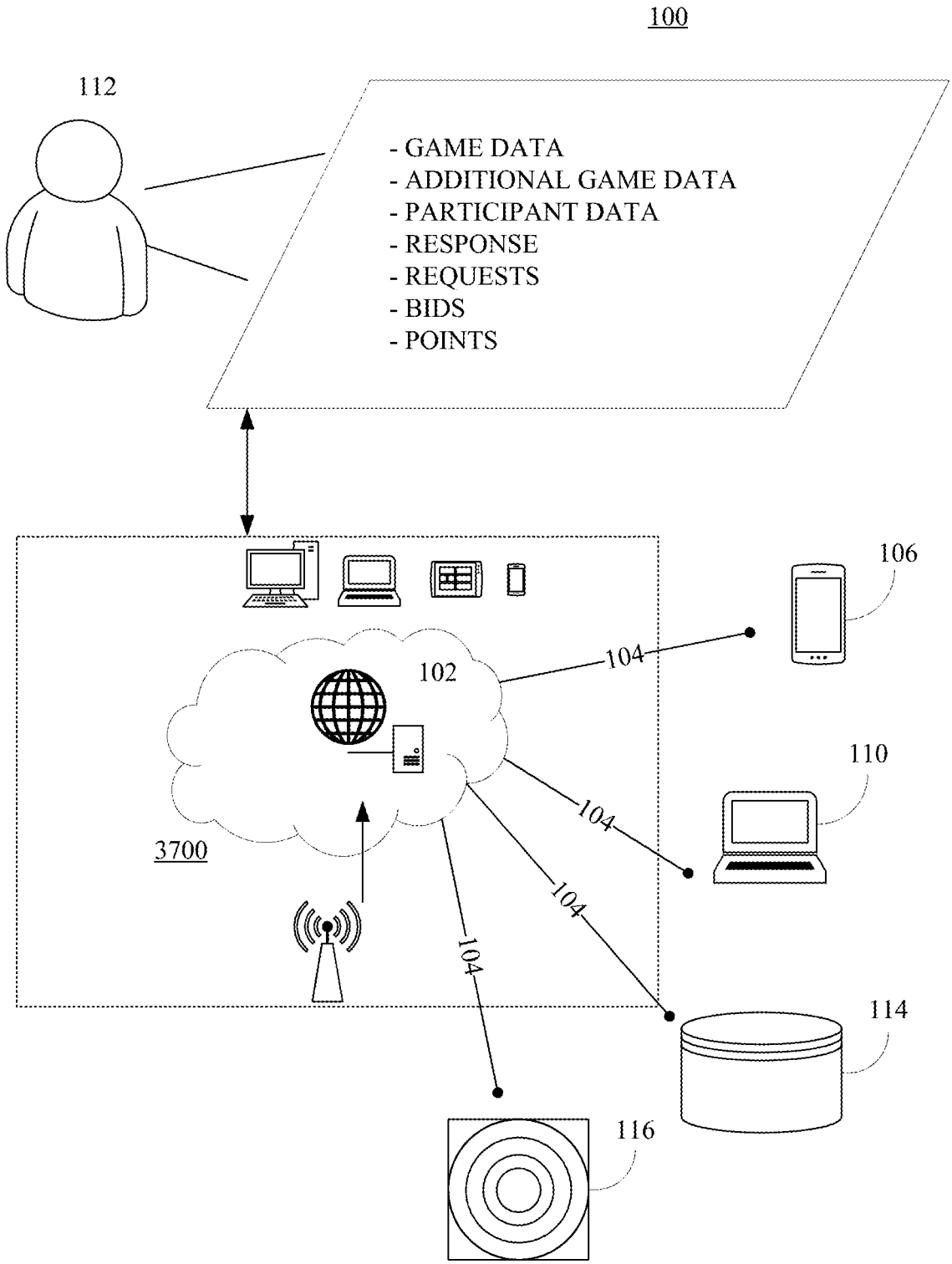
FIG. 1 is an illustration of an online platform consistent with various embodiments of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of systems and methods for facilitating betting in a game, embodiments of the present disclosure are not limited to use only in this context.

In general, the method disclosed herein may be performed by one or more computing devices. For example, in some embodiments, the method may be performed by a server computer in communication with one or more client devices over a communication network such as, for example, the Internet. In some other embodiments, the method may be performed by one or more of at least one server computer, at least one client device, at least one network device, at least one sensor, and at least one actuator. Examples of the one or more client devices and/or the server computer may include, a desktop computer, a laptop computer, a tablet computer, a personal digital assistant, a portable electronic device, a wearable computer, a smartphone, an Internet of Things (IoT) device, a smart electrical appliance, a video game console, a rack server, a super-computer, a mainframe computer, mini-computer, micro-computer, a storage server, an application server (e.g. a mail server, a web server, a real-time communication server, an FTP server, a virtual server, a proxy server, a DNS server etc.), a quantum computer, and so on. Further, one or more client devices and/or the server computer may be configured for executing a software application such as, for example, but not limited to, an operating system (e.g. Windows, Mac OS, Unix, Linux, Android, etc.) in order to provide a user interface (e.g. GUI, touch-screen based interface, voice-based interface, gesture-based interface etc.) for use by the one or more users and/or a network interface for communicating with other devices over a communication network. Accordingly, the server computer may include a processing device configured for performing data processing tasks such as, for example, but not limited to, analyzing, identifying, determining, generating, transforming, calculating, computing, compressing, decompressing, encrypting, decrypting, scrambling, splitting, merging, interpolating, extrapolating, redacting, anonymizing, encoding and decoding. Further, the server computer may include a communication device configured for communicating with one or more external devices. The one or more external devices may include, for example, but are not limited to, a client device, a third-party database, a public database, a private database and so on. Further, the communication device may be configured for communicating with the one or more external devices over one or more communication channels. Further, the one or more communication channels may include a wireless communication channel and/or a wired communication channel. Accordingly, the communication device may be configured for performing one or more of transmitting and receiving of information in electronic form. Further, the server computer may include a storage device configured for performing data storage and/or data retrieval operations. In general, the storage device may be configured for providing reliable storage of digital information. Accordingly, in some embodiments, the storage device may be based on technologies such as, but not limited to, data compression, data backup, data redundancy, deduplication, error correction, data fingerprinting, role-based access control, and so on.

Further, one or more steps of the method disclosed herein may be initiated, maintained, controlled and/or terminated based on a control input received from one or more devices operated by one or more users such as, for example, but not limited to, an end-user, an admin, a service provider, a service consumer, an agent, a broker and a representative thereof. Further, the user as defined herein may refer to a human, an animal or an artificially intelligent being in any state of existence, unless stated otherwise, elsewhere in the present disclosure. Further, in some embodiments, the one or more users may be required to successfully perform authentication in order for the control input to be effective. In general, a user of the one or more users may perform authentication based on the possession of a secret human-readable secret data (e.g. username, password, passphrase, PIN, secret question, secret answer etc.) and/or possession of a machine-readable secret data (e.g. encryption key, decryption key, bar codes, etc.) and/or or possession of one or more embodied characteristics unique to the user (e.g. biometric variables such as, but not limited to, fingerprint, palm-print, voice characteristics, behavioral characteristics, facial features, iris pattern, heart rate variability, evoked potentials, brain waves, and so on) and/or possession of a unique device (e.g. a device with a unique physical and/or chemical and/or biological characteristic, a hardware device with a unique serial number, a network device with a unique IP/MAC address, a telephone with a unique phone number, a smartcard with an authentication token stored thereupon, etc.). Accordingly, the one or more steps of the method may include communicating (e.g. transmitting and/or receiving) with one or more sensor devices and/or one or more actuators in order to perform authentication. For example, the one or more steps may include receiving, using the communication device, the secret human-readable data from an input device such as, for example, a keyboard, a keypad, a touch-screen, a microphone, a camera and so on. Likewise, the one or more steps may include receiving, using the communication device, the one or more embodied characteristics from one or more biometric sensors.

Further, one or more steps of the method may be automatically initiated, maintained and/or terminated based on one or more predefined conditions. In an instance, the one or more predefined conditions may be based on one or more contextual variables. In general, the one or more contextual variables may represent a condition relevant to the performance of the one or more steps of the method. The one or more contextual variables may include, for example, but are not limited to, location, time, identity of a user associated with a device (e.g. the server computer, a client device etc.) corresponding to the performance of the one or more steps, environmental variables (e.g. temperature, humidity, pressure, wind speed, lighting, sound, etc.) associated with a device corresponding to the performance of the one or more steps, physical state and/or physiological state and/or psychological state of the user, physical state (e.g. motion, direction of motion, orientation, speed, velocity, acceleration, trajectory, etc.) of the device corresponding to the performance of the one or more steps and/or semantic content of data associated with the one or more users. Accordingly, the one or more steps may include communicating with one or more sensors and/or one or more actuators associated with the one or more contextual variables. For example, the one or more sensors may include, but are not limited to, a timing device (e.g. a real-time clock), a location sensor (e.g. a GPS receiver, a GLONASS receiver, an indoor location sensor etc.), a biometric sensor (e.g. a fingerprint sensor), an environmental variable sensor (e.g. temperature sensor, humidity sensor, pressure sensor, etc.) and a device state sensor (e.g. a power sensor, a voltage/current sensor, a switch-state sensor, a usage sensor, etc. associated with the device corresponding to performance of the or more steps).

Further, the one or more steps of the method may be performed one or more number of times. Additionally, the one or more steps may be performed in any order other than as exemplarily disclosed herein, unless explicitly stated otherwise, elsewhere in the present disclosure. Further, two or more steps of the one or more steps may, in some embodiments, be simultaneously performed, at least in part. Further, in some embodiments, there may be one or more time gaps between performance of any two steps of the one or more steps.

Further, in some embodiments, the one or more predefined conditions may be specified by the one or more users. Accordingly, the one or more steps may include receiving, using the communication device, the one or more predefined conditions from one or more and devices operated by the one or more users. Further, the one or more predefined conditions may be stored in the storage device. Alternatively, and/or additionally, in some embodiments, the one or more predefined conditions may be automatically determined, using the processing device, based on historical data corresponding to performance of the one or more steps. For example, the historical data may be collected, using the storage device, from a plurality of instances of performance of the method. Such historical data may include performance actions (e.g. initiating, maintaining, interrupting, terminating, etc.) of the one or more steps and/or the one or more contextual variables associated therewith. Further, machine learning may be performed on the historical data in order to determine the one or more predefined conditions. For instance, machine learning on the historical data may determine a correlation between one or more contextual variables and performance of the one or more steps of the method. Accordingly, the one or more predefined conditions may be generated, using the processing device, based on the correlation.

Further, one or more steps of the method may be performed at one or more spatial locations. For instance, the method may be performed by a plurality of devices interconnected through a communication network. Accordingly, in an example, one or more steps of the method may be performed by a server computer. Similarly, one or more steps of the method may be performed by a client computer. Likewise, one or more steps of the method may be performed by an intermediate entity such as, for example, a proxy server. For instance, one or more steps of the method may be performed in a distributed fashion across the plurality of devices in order to meet one or more objectives. For example, one objective may be to provide load balancing between two or more devices. Another objective may be to restrict a location of one or more of an input data, an output data and any intermediate data there between corresponding to one or more steps of the method. For example, in a client-server environment, sensitive data corresponding to a user may not be allowed to be transmitted to the server computer. Accordingly, one or more steps of the method operating on the sensitive data and/or a derivative thereof may be performed at the client device.

Overview:

The present disclosure describes systems and methods to facilitate betting in a game. Further, the present disclosure may disclose a high tech ten seconds play by play IP to the worlds of sports. Further, the present disclosure may disclose play by play sports gaming application. Further, the play by play sports gaming application may include a no-risk and all-reward incentive program to ramp up the fun. Further, the play by play sports gaming application may bring passionate and casual fans of all ages closer to games and the competition within the games that may be loved and enjoyed by the fans. Further, the play by play sports gaming application may ultimately deepen the engagement between the fans and the games. Further, the play by play sports gaming application may include a platform with a real-time technology that may add fun and build customer and brand loyalty by allowing the fans to be a part of the games in a no-risk, all reward incentive program of "Fanbucks". Further, the play by play sports gaming application may be the next iteration of live event enhancement. Further, the play by play sports gaming application may keep the fans engaged in the games and may allow teams and broadcasters associated with the games multiple access and touchpoints to build a stronger relationship with the fans. Further, play by play sports gaming application may provide the fans with the play by play call gaming experience to all the live events. Further, play by play sports gaming application may be a play by play gambling platform that may be built on the fastest play by play results in the games. Further, the play by play sports gaming application may be accessible to all demographics. Further, the play by play sports gaming application may have simple user experience and play by play calls. Further, the play by play sports gaming application may provide the user to convert game points into "Fanbucks". Further, the "Fanbucks" may be redeemed for rewards with an in-application purchase. Further, the play by play sports gaming application may provide an incentive award program that may drive business and consumers to acquire more "Fanbucks". Further, the "Fanbucks" may promote users through points and credits that may be exchanged for goods and services.

Further, the play by play sports gaming application may be used to participate in state-run gambling sports betting. For example, Oregon has started sports wagering run by the state Lottery but is not doing live play by play as of now. Accordingly, the play by play sports gaming application may enable the Oregon state to allow for stadium wagering as well for a live Play by Play. For stadium wagering, the stadiums may need to leverage the disclosed technology with either a software application or devices using the disclosed method.

Further, the YCTP Fanbucks platform may create a custom currency to reward users, boost fan engagement and drive revenue. Further, the YCTP Fanbucks platform may provide in-application membership purchases that may allow fans to earn "Fanbucks" rewards, redeemable on a "Fanbucks" website and/or a "Fanbucks" application. Further, the "Fanbucks" rewards may be available through in-application purchases. Further, the YCTP Fanbucks platform may provide in-application Fanbucks and/or MyFanbucks reward sponsorship opportunities.

Further, the play by play sports gaming application may provide a partner-offering to teams and broadcasters that may be associated with games. Further, the partner offering that may be provided to the partners may include a YCTP innovative technology that may enable free play by play experience and an incentive rewards program to allow the partners to engage with the fans after the game and after the season. Further, continually engaging with fans and customers all year long that may drive the sales to funnel for the partners. Further, the play by play sports gaming application may allow the partners a powered forum that may instantly create a bridge the build relationships and gain better data on the audience and/or customers. Further, assisting the partners to efficiently market the existing customer base and attract new clients.

Further, the play by play sports gaming application may provide the partners with a plug and play technology, customized experiences, and data analytics. Further, the plug and play technology may include a YCTP platform that may allow broadcasters to instantly keep fans engaged for any live event by allowing the fans to make play by play calls with a result and incentive rewards programs as the action unfolds. Further, the customized experiences may include branded, pre-game and real-time mobile play by play experiences, push notifications, and promotions that may be hosted on a website associated with the partner and may be accessible through a YCTP application. Further, the data analytics may allow the partners to effectively target customers, build brand loyalty, influence purchasing habits and differentiate the brand from the competition. Further, the play by play sports gaming application may provide the partners with the fastest way to enhance live events with no cost or tech work. Further, the play by play sports gaming application may dramatically increase viewer engagement. Further, the play by play sports gaming application may provide new revenue opportunities. Further, the play by play sports gaming application may provide available white-label web experience. Further, the play by play sports gaming application may provide YCTP branded mobile applications for iOS and Android. Further, the play by play sports gaming application may provide consumer data to build relationships.

Further, the play by play sports gaming application may facilitate betting in a game within the MLB Ball Park App used by the Major League Baseball Fans for betting. Further, the play by play sports gaming application allows third party development and implementation for MLB teams for gaming and wagering.

Further, the play by play sports gaming application may facilitate betting in a game leveraging second screen viewing with broadcasters suck as ESPN, NBC, ABC, CBS, MLB Network, YouTube Tv, Amazon Prime Video, Hulu, Sling TV.

Further, the play by play sports gaming application may leverages AI and machine learning statistics such as MLB Stats API or Amazon's Statscast AI for determining odds for betting in a game.

Further, YCTP Fanbucks platform may be monetizable and multi-faceted that may allow the partners to connect with the consumers that may be better and on levels that may not be possible with traditional avenues. Further, the YCTP platform may bring users into restaurants, shops, services, on-line stores, hotels, travels, etc. that may be associated with the partners. Further, the YCTP platform may enable promoted posts that may appear pinned to the top of YCTP activity feed. Further, the posts may include 140 characters of text, pictures, and video. Further, the YCTP platform may enable the call to action buttons. Further, the buttons may be linked to an external webpage. Further, the YCTP platform may enable push notification and alerts.

Referring now to figures, FIG. 1 is an illustration of an online platform 100 consistent with various embodiments of the present disclosure. By way of non-limiting example, the online platform 100 to facilitate betting in a game may be hosted on a centralized server 102, such as, for example, a cloud computing service. The centralized server 102 may communicate with other network entities, such as, for example, a mobile device 106 (such as a smartphone, a laptop, a tablet computer etc.), other electronic devices 110 (such as desktop computers, server computers etc.), databases 114, and sensors 116 (such as a location sensor and a proximity sensor) over a communication network 104, such as, but not limited to, the Internet. Further, users of the online platform 100 may include relevant parties such as, but not limited to, end-users, administrators, service providers, service consumers and so on. Accordingly, in some instances, electronic devices operated by the one or more relevant parties may be in communication with the platform.

A user 112, such as the one or more relevant parties, may access online platform 100 through a web-based software application or browser. The web-based software application may be embodied as, for example, but not be limited to, a website, a web application, a desktop application, and a mobile application compatible with a computing device 3700.

Figure 2:
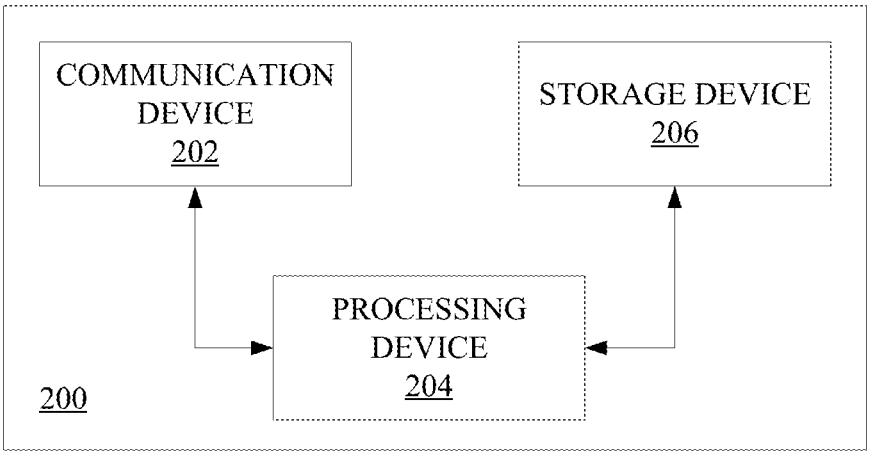
FIG. 2 is a block diagram of a system to facilitate betting in a game, in accordance with some embodiments.

FIG. 2 is a block diagram of a system 200 to facilitate betting in a game, in accordance with some embodiments. Accordingly, the system 200 may include a communication device 202, a processing device 204, and a storage device 206.

Further, the communication device 202 may be configured for receiving game data associated with at least one game from at least one game sensor. Further, the at least one game sensor may be configured to generate the game data. Further, the game data may include data associated with the at least one game currently in progression. Further, the at least one game may include a play by play game. Further, the play by play game may include a plurality of betting events. Further, the at least one game may include a baseball game, a basketball game, a rugby game, a tennis game, a hockey game, etc. Further, the communication device 202 may be configured for transmitting a plurality of options associated with an outcome of a betting event to at least one participant device associated with at least one participant. Further, the plurality of options may include various possible outcomes of the at least one game which may be chosen by the at least one participant. In an instance, the plurality of options may include a hit option, an out option, a walk option, and a score option. Further, the communication device 202 may be configured for receiving an option indication corresponding an option of the plurality of options from the at least one participant device. Further, the communication device 202 may be configured for receiving an actual outcome of the betting event from the at least one game sensor. Further, the communication device 202 may be configured for transmitting at least one response to the at least one participant device.

Further, the processing device 204 may be configured for analyzing the game data. Further, the processing device 204 may be configured for identifying an occurrence of the betting event based on the analyzing. Further, the processing device 204 may be configured for comparing the option indication and the actual outcome. Further, the processing device 204 may be configured for determining the at least one response based on the comparing.

Further, the storage device 206 may be configured for storing the at least response corresponding to the betting event and the betting event in a database (such as a database in the databases 114).

Further, in some embodiments, the receiving of the option indication corresponding to the betting event may be associated with a time span. Further, the option indication may be valid for the betting event during the time span.

Further, in some embodiments, the processing device 204 may be configured for analyzing the at least one response. Further, the processing device 204 may be configured for determining one or more points associated with the at least one response based on the analyzing. Further, the communication device 202 may be configured for transmitting the one or more points to the at least one participant device.

Further, in some embodiments, the processing device 204 may be configured for generating a virtual currency associated with the at least one participant. Further, the virtual currency may be associated with a plurality of denominations. Further, the plurality of denominations may be based on the one or more points. Further, the processing device 204 may be configured for processing at least one transaction with at least one participant merchant based on an exchange of the virtual currency against at least one object. Further, the exchange of the currency against the at least one object may be done between the at least one participant and the at least one participant merchant.

Further, in some embodiments, the processing device 204 may be configured for analyzing the option indication and the at least one response of the at least one participant. Further, the processing device 204 may be configured for determining at least one target participant of the at least one participant based on the analyzing. Further, the communication device 202 may be configured for transmitting at least one notification to the at least one target participant.

Further, in some embodiments, the communication device 202 may be configured for receiving at least one additional game data from the at least one additional game sensor. Further, the at least one additional game sensor may be configured to generate the at least one additional sensor data. Further, the processing device 204 may be configured for analyzing the at least one additional game data and the game data. Further, the processing device 204 may be configured for predicting the occurrence of the betting event based on the analyzing.

Further, in some embodiments, the communication device 202 may be configured for receiving at least one participant data associated with the at least one participant from at least one participant sensor. Further, the at least one participant sensor may be configured for generating the at least one participant data. Further, the processing device 204 may be configured for analyzing the at least one participant data and the game data.

Further, the processing device 204 may be configured for generating at least one engagement data based on the analyzing. Further, the at least one engagement data may be associated with the engagement of the at least one participant with the at least one game. Further, the determining of the at least one response may be based on the at least one engagement data.

Further, in some embodiments, the storage device 206 may be further configured for retrieving at least one statistical data associated with the at least one game from a database. Further, the database comprises the at least one statistical data. Further, the processing device 204 may be further configured for analyzing the at least one statistical data and the game data using machine learning. Further, the processing device 204 may be configured for generating betting odd data corresponding to the betting event based on the analyzing. Further, the betting odd data may be associated with an odds for the betting event. Further, the odd, in an instance, may be associated with a likelihood the betting event in the at least one game. Further, the communication device 202 may be further configured for transmitting the betting odd data to the at least one participant device.

Further, in some embodiments, the at least one participant device comprises at least one companion application associated with the at least one game. Further, the at least one companion application present at least one game information associated with the at least one game. Further, the at least one companion application configured for transmitting the plurality of options associated with the outcome of the betting event to the at least one participant device. Further, the at least one companion application configured for receiving the option indication corresponding the option from the at least one participant device.

Further, in some embodiments, the at least one participant device comprises at least one broadcast receiver associated with the at least one game. Further, the at least one broadcast receiver may be configured for transmitting the plurality of options associated with the outcome of the betting event to the at least one participant device. Further, the at least one broadcast receiver may be configured for receiving the option indication corresponding the option from the at least one participant device.

Figure 3:
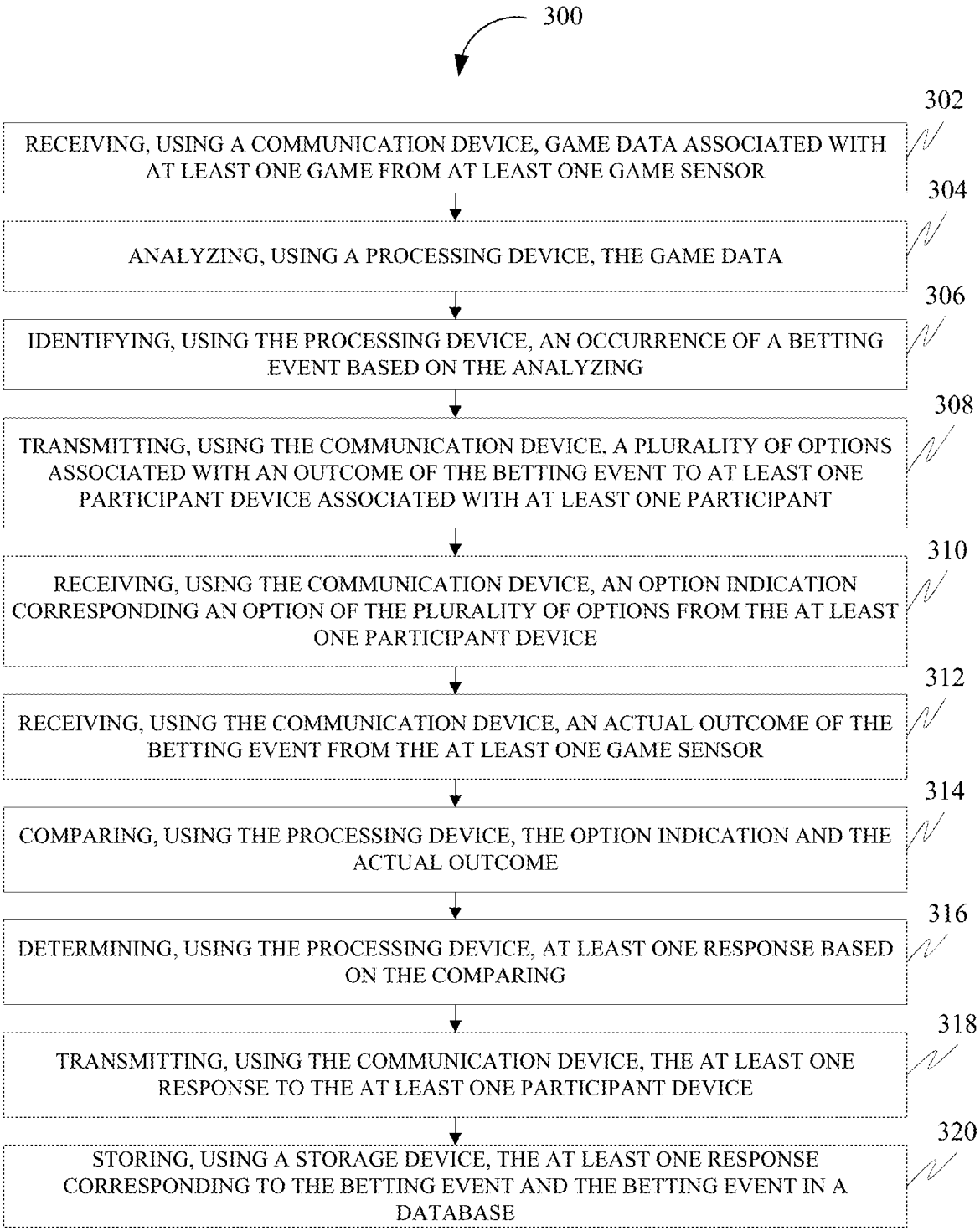
FIG. 3 is a flowchart of a method to facilitate betting in a game, in accordance with some embodiments.

FIG. 3 is a flowchart of a method 300 to facilitate betting in a game, in accordance with some embodiments. Accordingly, at 302, the method 300 may include a step of receiving, using a communication device, game data associated with at least one game from at least one game sensor. Further, the game data may include data associated with the at least one game currently in progression. Further, the at least one game may be held in a stadium. Further, the at least one game may include a play by play game. Further, the play by play game may include a plurality of betting events. Further, the at least one game may include a baseball game, a basketball game, a rugby game, a tennis game, a hockey game, etc. Further, the at least one game sensor may be configured to generate the game data.

Further, at 304, the method 300 may include a step of analyzing, using a processing device, the game data.

Further, at 306, the method 300 may include a step of identifying, using the processing device, an occurrence of a betting event based on the analyzing.

Further, at 308, the method 300 may include a step of transmitting, using the communication device, a plurality of options associated with an outcome of the betting event to at least one participant device associated with at least one participant. Further, the plurality of options may include various possible outcomes of the at least one game which may be chosen by the at least one participant. In an instance, the plurality of options may include a hit option, an out option, a walk option, and a score option.

Figure 21:
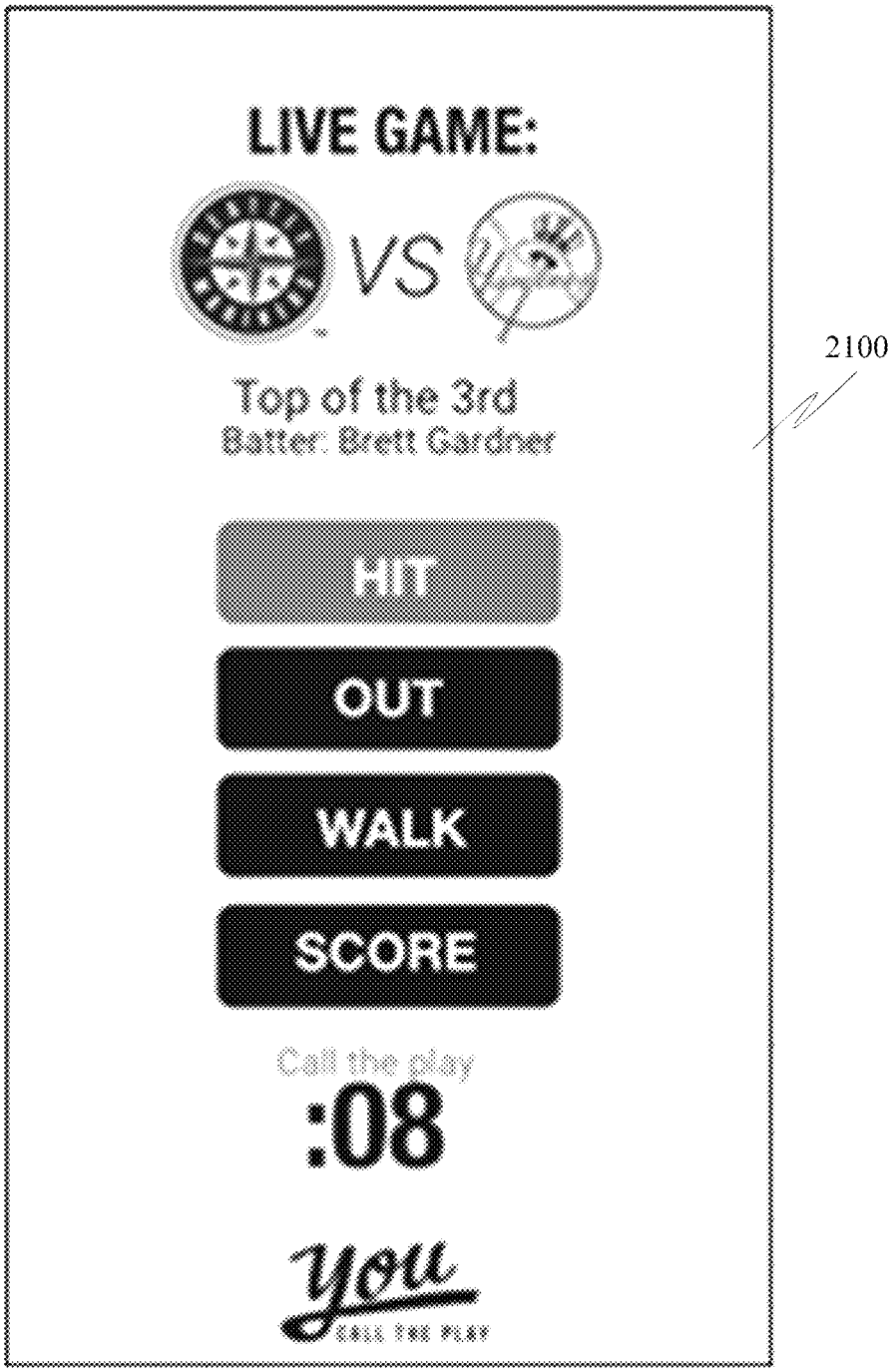
FIG. 21 is a screenshot of a predictive play-calling user interface of the "you call the play" application, in accordance with some embodiments.
Figure 28:
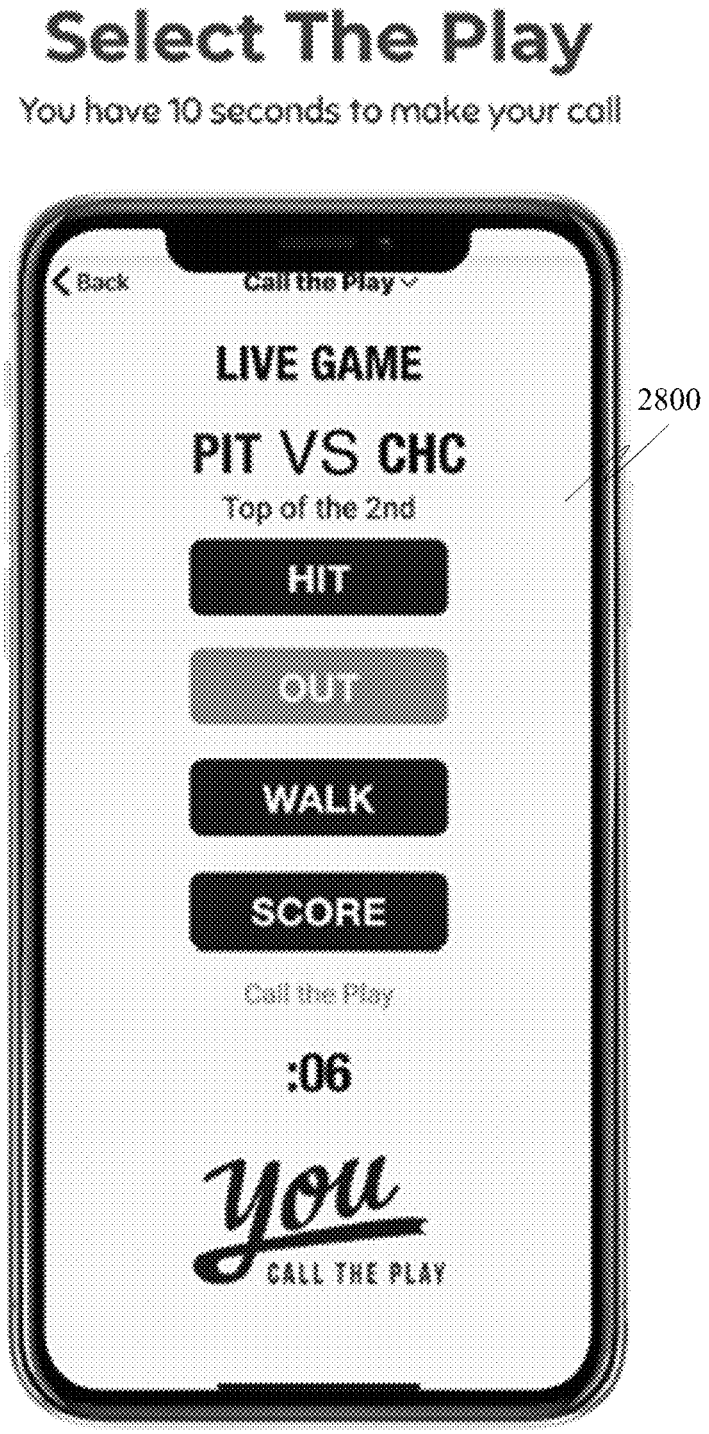
FIG. 28 is a screenshot of a call the play user interface of the "you call the play" application, in accordance with some embodiments.

Further, at 310, the method 300 may include a step of receiving, using the communication device, an option indication corresponding an option of the plurality of options from the at least one participant device. Further, as shown in FIG. 21, the at least one participant, in an instance, may choose the hit option, as the option indication from the plurality of options. Further, as shown in FIG. 28, the at least one participant, in an instance, may choose the out option, as the option indication from the plurality of options. Further, the at least one participant device may include the mobile device and other electronic devices 110.

Further, at 312, the method 300 may include a step of receiving, using the communication device, an actual outcome of the betting event from the at least one game sensor.

Further, at 314, the method 300 may include a step of comparing, using the processing device, the option indication and the actual outcome.

Figure 22:
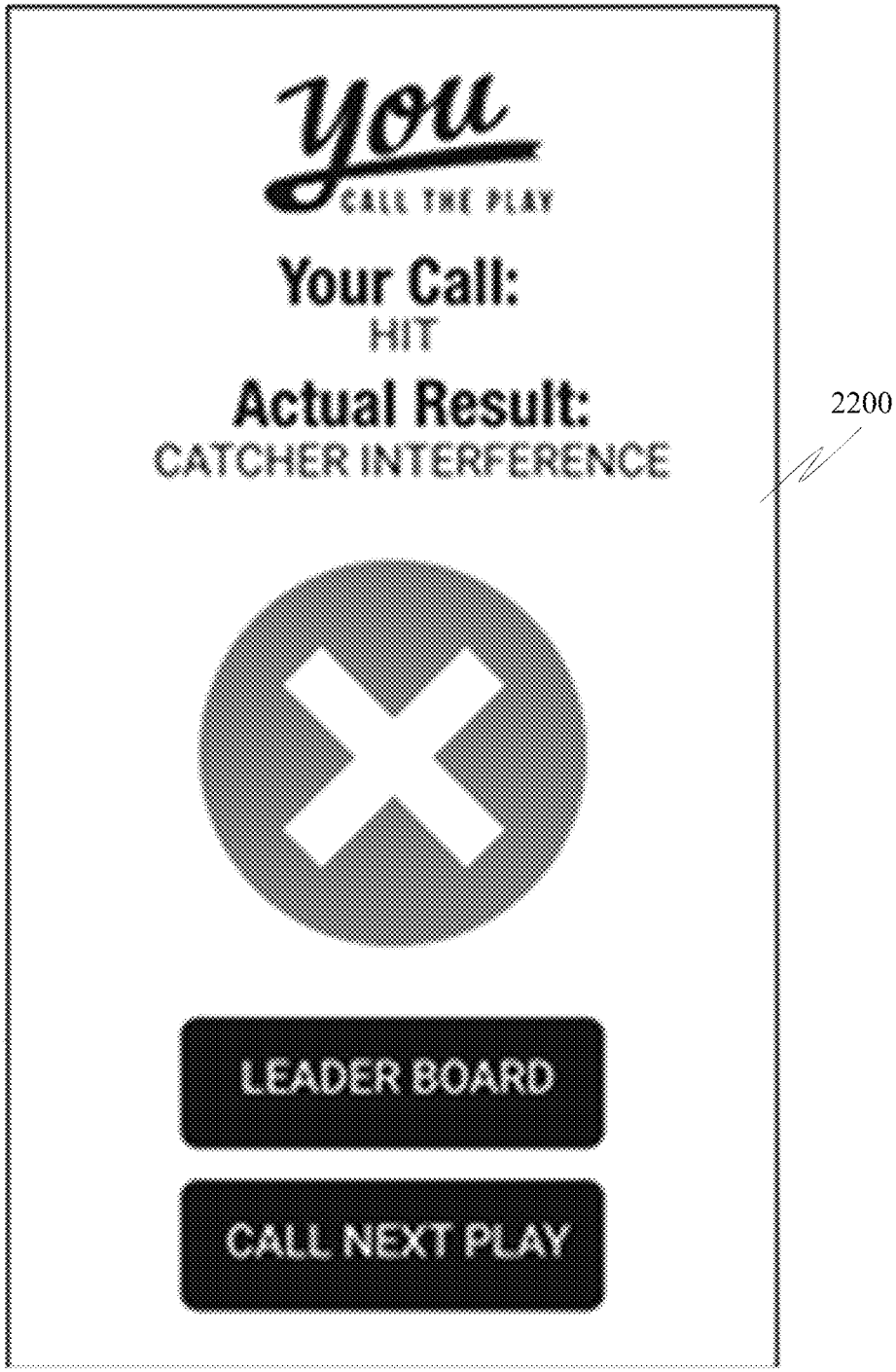
FIG. 22 is a screenshot of a predictive play-calling result user interface of the "you call the play" application, in accordance with some embodiments.
Figure 31:
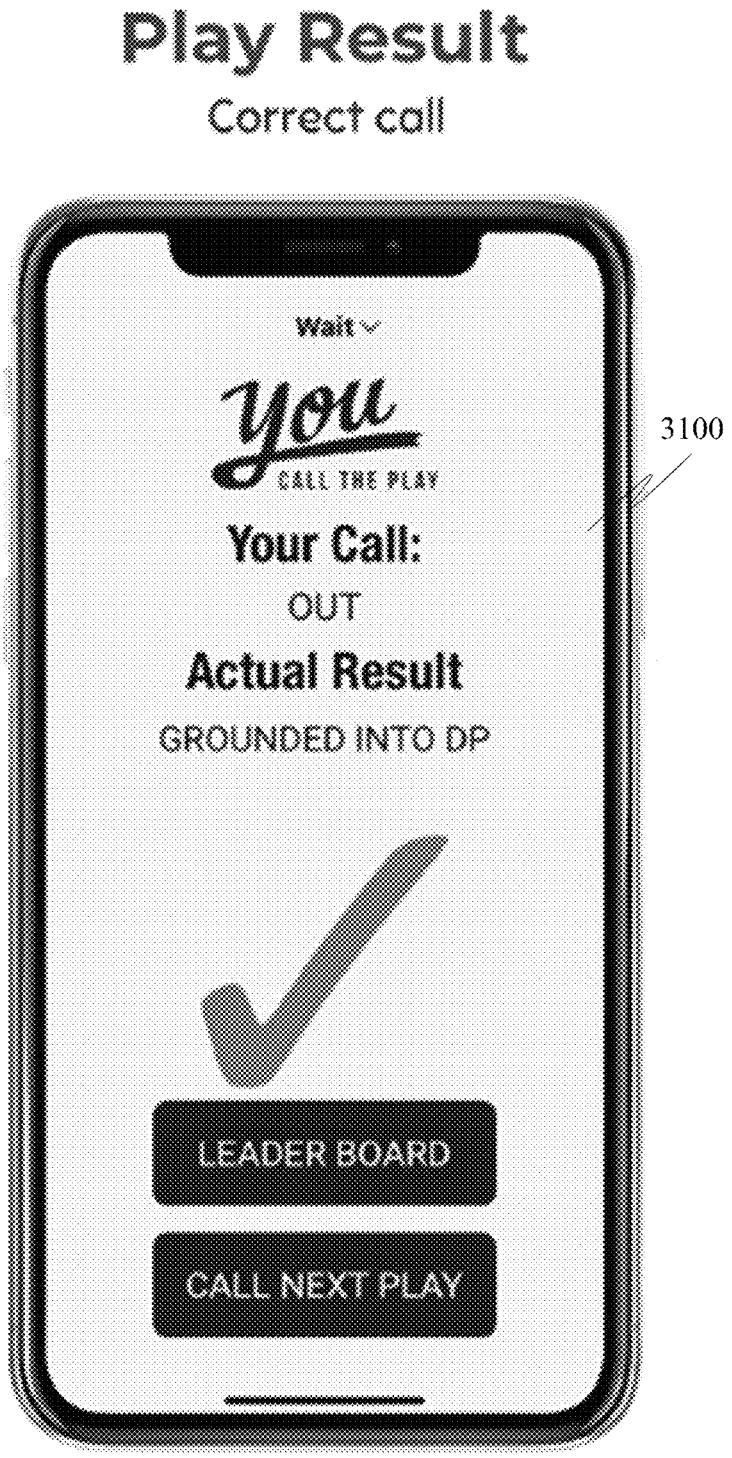
FIG. 31 is a screenshot of a correct call of play result user interface of the "you call the play" application, in accordance with some embodiments.

Further, at 316, the method 300 may include a step of determining, using the processing device, at least one response based on the comparing. Further, the at least one response may include a correct response, an incorrect response, etc. In an instance, as shown in FIG. 22, the at least one response may be the incorrect response. Further, in an instance, as shown in FIG. 31, the at least one response may be the correct response.

Further, at 318, the method 300 may include a step of transmitting, using the communication device, the at least one response to the at least one participant device.

Further, at 320, the method 300 may include a step of storing, using a storage device, the at least one response corresponding to the betting event and the betting event in a database (such as a database in the databases 114).

Further, in some embodiments, the receiving of the option indication corresponding to the betting event may be associated with a time span. In an instance, the time span may be 10 seconds. Further, the option indication may be valid for the betting event during the time span.

Further, in some embodiments, the at least one participant device comprises at least one companion application associated with the at least one game. Further, the at least one companion application present at least one game information associated with the at least one game. Further, the at least one companion application configured for transmitting the plurality of options associated with the outcome of the betting event to the at least one participant device. Further, the at least one companion application configured for receiving the option indication corresponding the option from the at least one participant device.

Further, in some embodiments, the at least one participant device comprises at least one broadcast receiver associated with the at least one game. Further, the at least one broadcast receiver may be configured for transmitting the plurality of options associated with the outcome of the betting event to the at least one participant device. Further, the at least one broadcast receiver may be configured for receiving the option indication corresponding the option from the at least one participant device.

Figure 4:
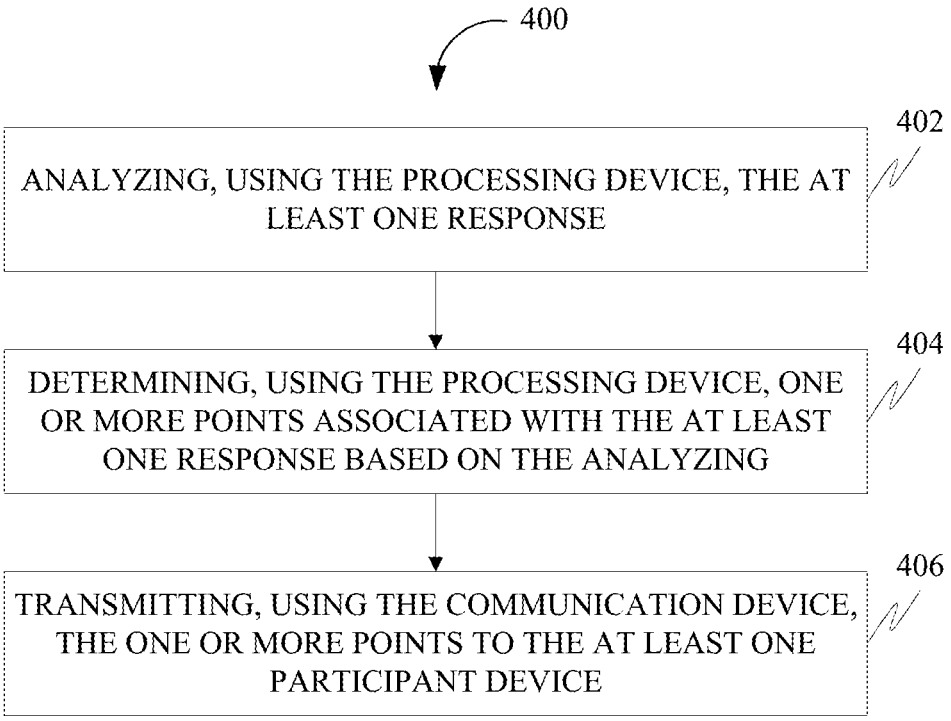
FIG. 4 is a flowchart of a method to facilitate the determination of one or more points, in accordance with some embodiments.

FIG. 4 is a flowchart of a method 400 to facilitate the determination of one or more points, in accordance with some embodiments. Accordingly, at 402, the method 400 may include a step of analyzing, using the processing device, the at least one response.

Further, at 404, the method 400 may include a step of determining, using the processing device, the one or more points associated with the at least one response based on the analyzing. Further, the one or more points may be determined on the basis of a total number of the correct responses.

Further, at 406, the method 400 may include a step of transmitting, using the communication device, the one or more points to the at least one participant device.

Figure 5:
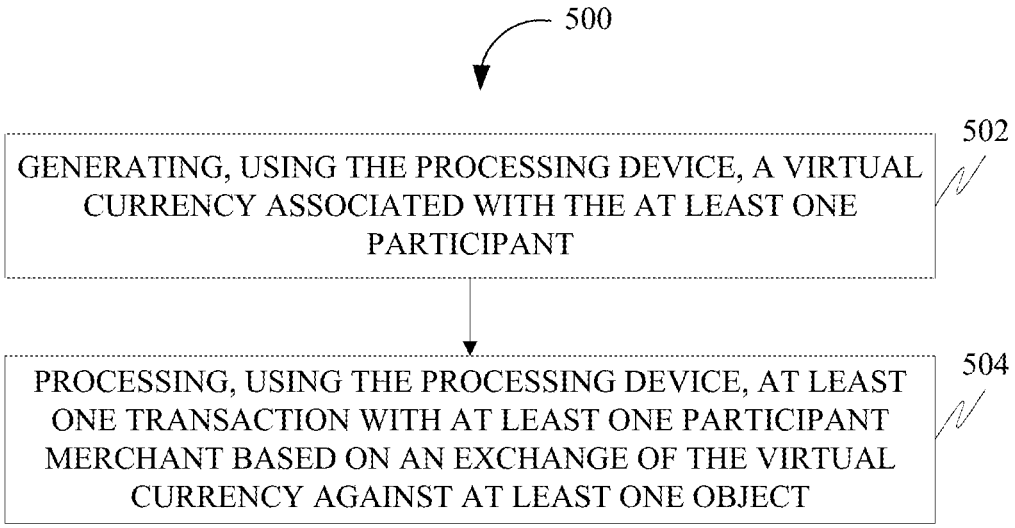
FIG. 5 is a flowchart of a method to facilitate at least one transaction with at least one participant merchant, in accordance with some embodiments.

FIG. 5 is a flowchart of a method 500 to facilitate at least one transaction with at least one participant merchant, in accordance with some embodiments. Accordingly, at 502, the method 500 may include a step of generating, using the processing device, a virtual currency associated with the at least one participant. Further, the virtual currency may be associated with a plurality of denominations. Further, the plurality of denominations may be based on the one or more points.

Further, at 504, the method 500 may include a step of processing, using the processing device, the at least one transaction with the at least one participant merchant based on an exchange of the virtual currency against at least one object. Further, the at least one transaction may be facilitated through an online payment gateway. Further, the at least one object may include a product and/or a service associated with the at least one participant merchant. Further, the exchange of the virtual currency against the at least one object may be done between the at least one participant and the at least one participant merchant.

Figure 6:
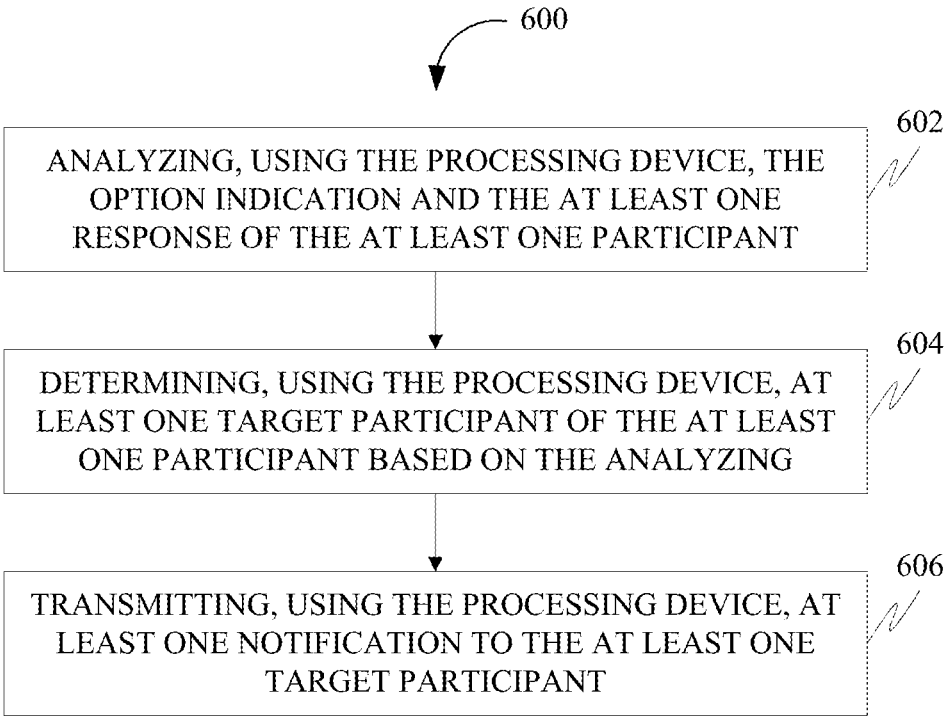
FIG. 6 is a flowchart of a method to facilitate the transmission of at least one notification to at least one target participant, in accordance with some embodiments.

FIG. 6 is a flowchart of a method 600 to facilitate the transmission of at least one notification to at least one target participant, in accordance with some embodiments. Accordingly, at 602, the method 600 may include a step of analyzing, using the processing device, the option indication and the at least one response of the at least one participant.

Further, at 604, the method 600 may include a step of determining, using the processing device, the at least one target participant of the at least one participant based on the analyzing. Further, the at least one target participant may include a participant on whom an advertiser may wish to advertise a product/service. Further, the at least one target participant may be determined on the basis of data analytics of the at least one participant.

Further, at 606, the method 600 may include a step of transmitting, using the processing device, the at least one notification to the at least one target participant.

Figure 7:
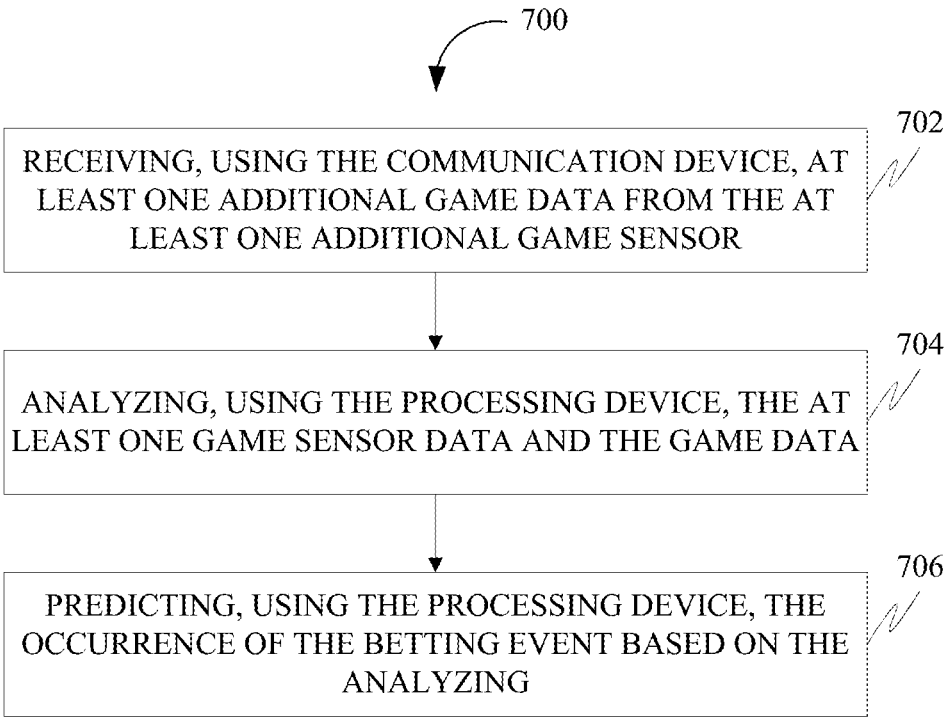
FIG. 7 is a flowchart of a method to facilitate the prediction of the occurrence of a betting event, in accordance with some embodiments.

FIG. 7 is a flowchart of a method 700 to facilitate the prediction of the occurrence of a betting event, in accordance with some embodiments. Accordingly, at 702, the method 700 may include a step of receiving, using the communication device, at least one additional game data from the at least one additional game sensor. Further, the at least one additional game sensor may be configured to generate the at least one additional game data. Further, the additional game data may include data associated with the at least one game currently in progression.

Further, at 704, the method 700 may include a step of analyzing, using the processing device, the at least one additional game data and the game data.

Further, at 706, the method 700 may include a step of predicting, using the processing device, the occurrence of the betting event based on the analyzing.

Figure 8:
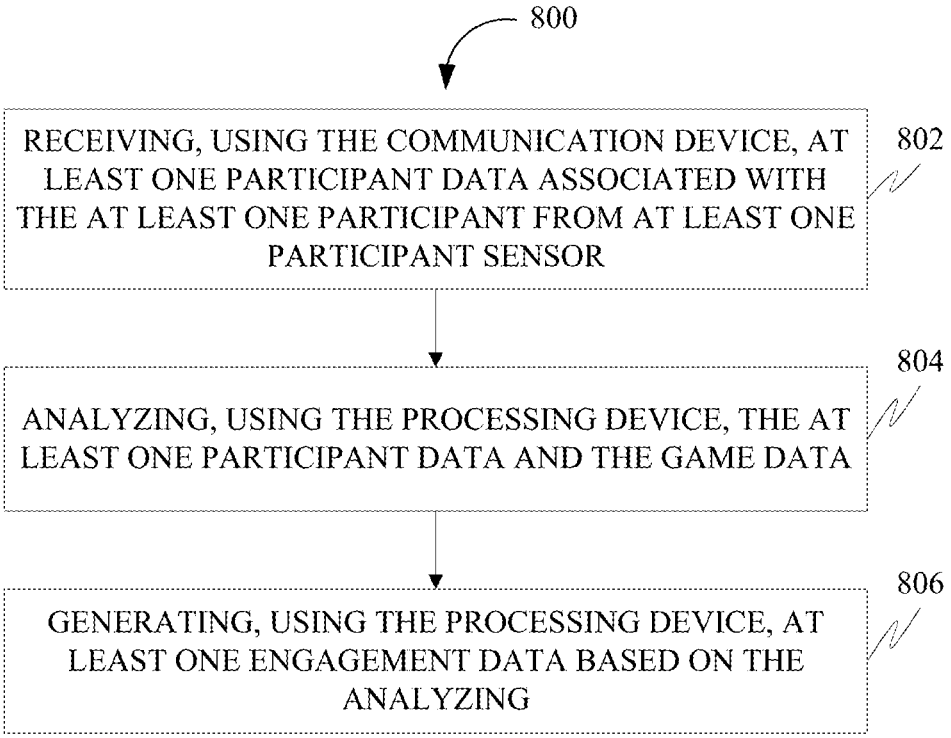
FIG. 8 is a flowchart of a method to facilitate the determination of at least one response, in accordance with some embodiments.

FIG. 8 is a flowchart of a method 800 to facilitate the determination of at least one response, in accordance with some embodiments. Accordingly, at 802, the method 800 may include a step of receiving, using the communication device, at least one participant data associated with the at least one participant from at least one participant sensor. Further, the at least one participant sensor may include a location sensor, a proximity sensor, etc. Further, the at least one participant sensor may be configured for generating the at least one participant data.

Further, at 804, the method 800 may include a step of analyzing, using the processing device, the at least one participant data and the game data.

Further, at 806, the method 800 may include a step of generating, using the processing device, at least one engagement data based on the analyzing. Further, the at least one engagement data may be associated with the engagement of the at least one participant with the at least one game. Further, the determining of the at least one response may be based on the at least one engagement data.

Figure 9:
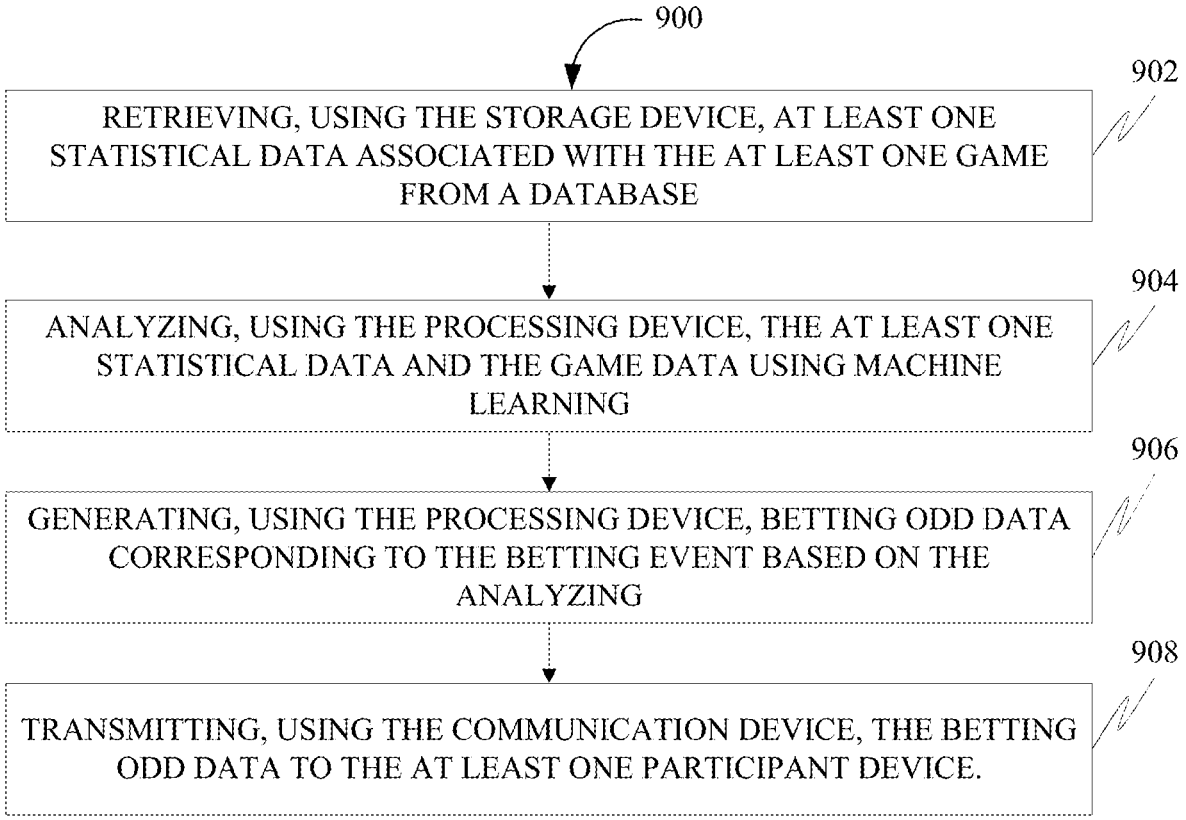
FIG. 9 is a flowchart of a method to facilitate the generation of a betting odd associated with a betting event, in accordance with some embodiments.

FIG. 9 is a flowchart of a method 900 to facilitate the generation of a betting odd associated with a betting event, in accordance with some embodiments. Accordingly, at 902, the method 900 may include a step of retrieving, using the storage device, at least one statistical data associated with the at least one game from a database. Further, the database may include the at least one statistical data. Further, the at least one statistical data may be associated with historical statistics of the at least one game. Further, the historical statistics may include scores, innings, etc.

Further, at 904, the method 900 may include a step of analyzing, using the processing device, the at least one statistical data and the game data using machine learning. Further, the at least one statistical data and the game data may be analyzed using an artificial intelligence analysis.

Further, at 906, the method 900 may include a step of generating, using the processing device, betting odd data corresponding to the betting event based on the analyzing. Further, the betting odd data may be associated with an odds for the betting event. Further, the odd, in an instance, may be associated with a likelihood the betting event in the at least one game.

Further, at 908, the method 900 may include a step of transmitting, using the communication device, the betting odd data to the at least one participant device.

Figure 10:
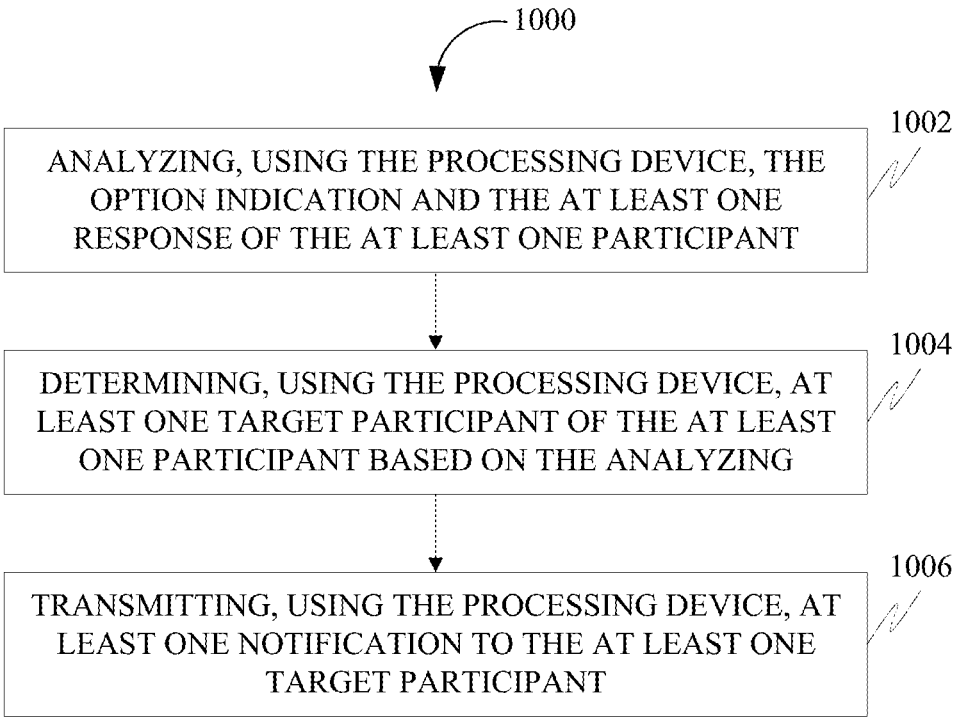
FIG. 10 is a flowchart of a method to facilitate the transmission at least one notification to at least one target participant, in accordance with some embodiments.

FIG. 10 is a flowchart of a method 1000 to facilitate the transmission at least one notification to at least one target participant, in accordance with some embodiments. Accordingly, at 1002, the method 1000 may include a step of analyzing, using the processing device, the option indication and the at least one response of the at least one participant.

Further, at 1004, the method 1000 may include a step of determining, using the processing device, the at least one target participant of the at least one participant based on the analyzing. Further, the at least one target participant may include a participant on whom an advertiser may wish to advertise a product/service. Further, the at least one target participant may be determined on the basis of data analytics of the at least one participant.

Further, at 1006, the method 1000 may include a step of transmitting, using the processing device, the at least one notification to the at least one target participant.

Figure 11:
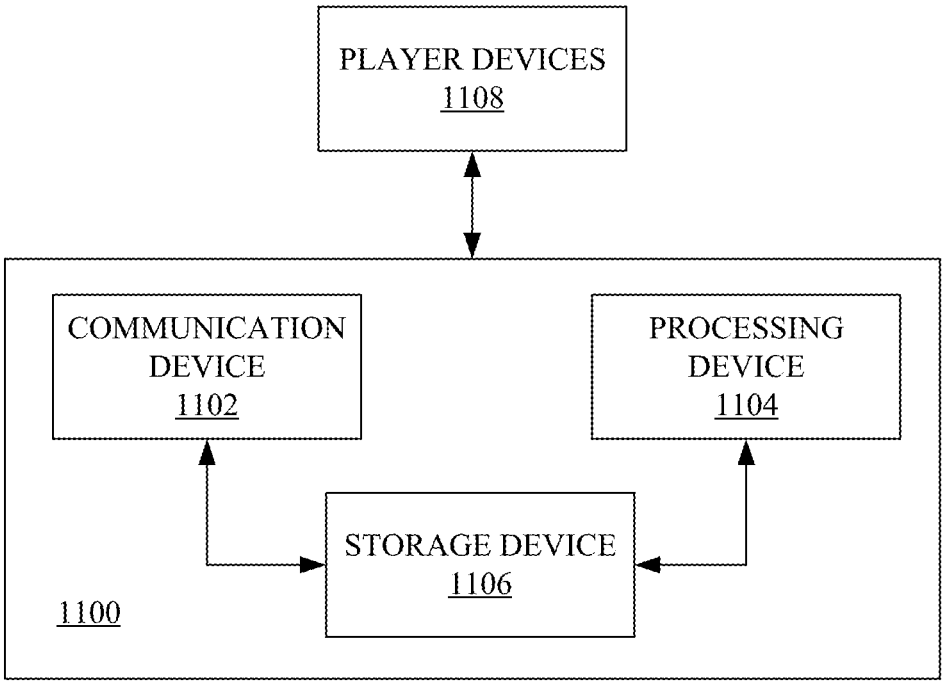
FIG. 11 is a block diagram of a system to facilitate participating in the gameplay of a game, in accordance with some embodiments.

FIG. 11 is a block diagram of a system 1100 to facilitate participating in the gameplay of a game, in accordance with some embodiments. Accordingly, the system may include a processing device 1104, a communication device 1102, and a storage device 1106. Further, one or more player devices 1108 may be communicatively coupled with the system.

Further, the communication device 1102 may be configured for receiving one or more requests from one or more player devices 1108 associated with one or more players. Further, the one or more requests may include a request for participating in the gameplay. Further, the communication device 1102 may be configured for receiving a bid associated with the at least one gameplay from the one or more player devices 1108. Further, the bid, in an instance, may include a predicted game event corresponding to the at least one of a game event. Further, the communication device 1102 may be configured for transmitting one or more points to the one or more player devices 1108. Further, the one or more points associated with the one or more players may be transmitted to the one or more player devices 1108.

Further, the processing device 1104 may be configured for determining the one or more points associated with the one or more players based on the bid and at least one gameplay data. Further, the bid and the at least one gameplay data may be analyzed using at least one analyzing method. Further, the at least one analyzing method may include comparing, interpreting, statistical analyzing, etc. Further, the one or more points may be determined based on analyzing the bid may be associated with the one or more players and the at least one gameplay data.

Further, the storage device 1106 may be configured for retrieving the at least one gameplay data associated with the at least one gameplay from a database. Further, at least one gameplay data may be associated with at least one game. Further, the at least one game, in an instance, may include a baseball game, a soccer game, a football game, a basketball game, etc.

Further, the one or more player devices 1108 may be associated with the one or more players. Further, the one or more player devices 1108 may include IoT based devices such as smartphones, smartwatches, tablets, personal computers (PCs), desktops, laptops, and so on. Further, the one or more players may be individuals that may want to participate in the gameplay of the game.

Figure 12:
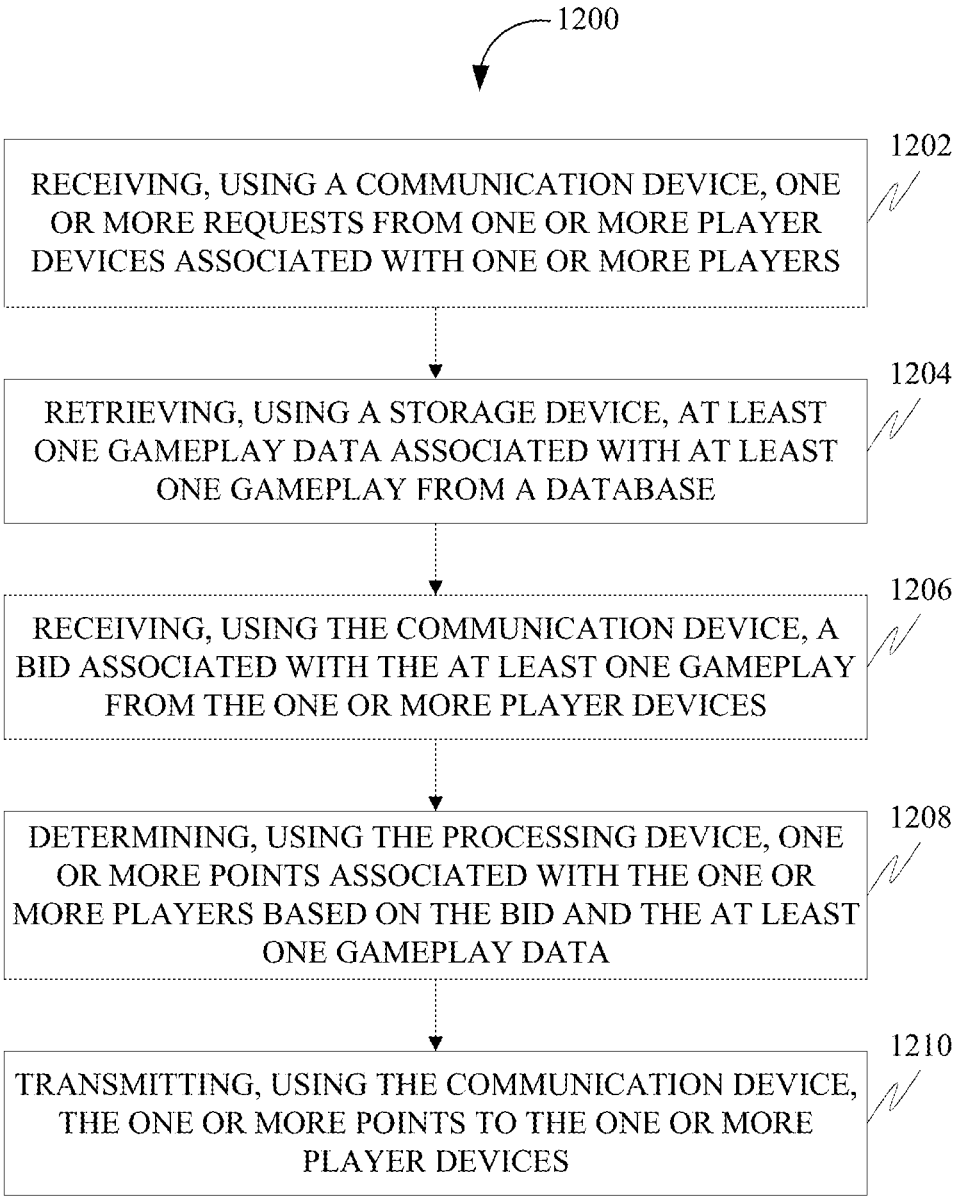
FIG. 12 is a flowchart of a method to facilitate participating in the gameplay of a game, in accordance with some embodiments.

FIG. 12 is a flowchart of a method 1200 to facilitate participating in the gameplay of a game, in accordance with some embodiments. Accordingly, at 1202, the method 1200 may include a step of receiving, using a communication device, one or more requests from one or more player devices associated with one or more players. Further, the one or more requests may include a request for participating in the gameplay. Further, the participating, in an instance, may include gambling. Further, the one or more requests may request made to an online platform (such as online platform 100). Further, the one or more requests, in an instance, may be generated by one or more players using the one or more player devices. Further, the one or more players may register the one or more requests from a web-based application. Further, the web-based application may be installed in the one or more player devices. Further, the web-based application may be hosted by the online platform 100. Further, the one or more players may be individuals that may want to participate in the gameplay of at least one game. Further, the one or more player devices, in an instance, may include an IoT based device configured to communicate with the online platform 100. Further, the one or more player devices, in an instance, may include devices such as, but not limited to, smartphones, smartwatches, tablets, personal computers (PCs), desktops, laptops, and so on.

Further, at 1204, the method 1200 may include a step of retrieving, using a storage device, at least one gameplay data associated with at least one gameplay from a database. Further, at least one gameplay data may be associated with the at least one game. Further, the at least one game, in an instance, may include a baseball game, a soccer game, a football game, a basketball game, etc. Further, the at least one gameplay data, in an instance, may include at least one of a game event corresponding to each game player of at least one game player. Further, the at least one game player may be associated with the at least one game. Further, the at least one game player, in an instance, may play the at least one game. Further, at least one of the game event may be associated with the at least one game. Further, at least one game player may perform at least one of the game event. Further, the at least one of the game event may include a score event, a null event, a dismiss event, etc. Further, the database, in an instance, may be configured to store the at least one gameplay data in an organized form, which may be electronically accessible to the online platform 100. Further, the online platform 100, in an instance, may retrieve the at least one gameplay data by using a web-based application. Further, the web-based application, in an instance may be installed on one or more administrator devices. Further, the one or more administrator devices may be associated with the administrator. Further, the web-based application, in an instance, may be hosted by the online platform 100.

Further, at 1206, the method 1200 may include a step of receiving, using the communication device, a bid associated with the at least one gameplay from the one or more player devices. Further, the bid, in an instance, may include a predicted game event corresponding to the at least one of the game event. Further, the predicted game event may be predicted by the one or more players before the at least one of the game event may occur. Further, the predicted game event may be a prediction of the at least one of the game event. Further, the bid may be provided by one or more player devices associated with one or more players. Further, in an instance, the online platform 100 may receive the bid associated with the one or more players. Further, the online platform 100 may receive the bid by a web-based application. Further, the web-based application, in an instance, may be installed in the one or more player devices. Further the web-based application, in an instance, may be hosted by the online platform 100.

Further, at 1208, the method 1200 may include a step of determining, using the processing device, one or more points associated with the one or more players based on the bid and the at least one gameplay data. Further, the bid and the at least one gameplay data may be analyzed using at least one analyzing method. Further, the at least one analyzing method may include comparing, interpreting, statistical analyzing, etc. Further, each point of the one more points may be associated with each player of the one or more players. Further, the each point may be determined based on analyzing the bid associated with the each player and the at least one gameplay data. Further, the online platform 100, in an instance, may determine the one or more points associated with one or more players. Further, the online platform 100 may determine the point by a web-based application. Further, the web-based application may be installed in the one or more administrator devices. Further, the web-based application may be hosted by the online platform 100.

Further, at 1210, the method 1200 may a step of transmitting, using the communication device, the one or more points to the one or more player devices. Further, the one or more player devices may be associated with the one or more players. Further, each of the one or more player devices may be associated with the each player the one or more players. Further, the each point associated with the each player may be transmitted to the each player device associated with the each player. Further, the online platform 100 may transmit the one or more points using a web-based application. Further, the web-based application may be installed on the one or more administrator devices. Further, the web-based application may be hosted by the online platform 100.

Further, in an embodiment, a web-based application ("You Call the Play") that may facilitate participating in the gameplay of a game. Further, the web-based application may include an "introduction" screen. Further, the "introduction" screen may include a loading screen that may be introduced with a trademarked logo of the "You Call the Play".

Further, the "You Call the Play" may include a login screen. Further, the login screen may direct a user to sign in. Further, the user may sign in by creating an account. Further, the account may be created with at least one of a method. Further, the at least one method may include creating the account with email, creating the account with Gmail, and creating the account with Facebook. Further, the "You Call the Play" may provide the user with a play ball to continue.

Further, the "You Call the Play" may include a create account screen. Further, the create account screen may include a user information section, a user agreement, a cancel button, and a trademarked "You Call the Play" ("YCTP") logo. Further, the user may be required to enter a username, a password, an email, and a time zone in the user information section. Further, the user may be required to agree to official rules, a privacy policy, and a term of use. Further, the cancel button may be located on create account screen that may facilitate returning to a previous screen.

Further, the "You Call the Play" may include a password reset screen. Further, the password reset screen may include a textbox and a trademark "YCTP" logo. Further, the textbox may require the user to enter an email and/or a username.

Further, the "You Call the Play" may include an instruction screen. Further, the instruction screen may include a set of detailed instruction on how to play the "You Call the Play".

Further, the "You Call the Play" may include an active game screen. Further, the active game screen may include a trademark "YCTP" logo, a game screen, a calendar feature, active games, a live game, a notification, and a live score and inning of an active game. Further, the game screen may be updated daily with Major League Baseball (MLB) games. Further, the calendar feature may provide features such as calendar may let the user see previous game outcomes, and points for each game, the calendar may let the user buy tickets for an upcoming game, and calendar may let the user choose a specific teams schedule. Further, the active games may show the user active games for a given day. Further, the live game may allow the user to enter a live game. Further, the notification may provide the user to set a notification for an upcoming game.

Further, the "You Call the Play" may include a leaderboard screen. Further, the leaderboard screen may include a trademark "YCTP" logo, a user option that may allow the user to select another user and scan over the another user profile, leaderboard options, and a play button. Further, the user option may allow the user to send/request friendship to the another user. Further, the leaderboard options may include three options. Further, the three options may include a live game, a custom, and an all-time. Further, the live game may include live game information, a user with most points, placement of all players, and active user place in a live game. Further, the custom may provide the user to set a custom leaderboard between users. Further, the all-time may show the user the highest point earning user and active user all-time place in a database. Further, the user may select the play button and may begin calling live plays.

Further, the "You Call the Play" may include a choose the play screen of a live game. Further, the choose the play screen may include a trademarked "YCTP" logo, a live action play calling, a call the play, a trademarked logo, and 4 options. Further, the live action play calling may provide the user to enter the live action play calling. Further, the call the play may provide the user with fifteen seconds to call the play. Further, the trademark logo may represent each corresponding team, Further, the 4 options may include a hit, an out, a walk, and a score.

Further, the "You Call the Play" may include a play result screen of a live screen. Further, the play result screen may include a trademarked "YCTP" logo, a button input to send back to leaderboard, a button input to send directly to the next play call, a correct chosen play, an incorrect chosen play, voids, and a timer set to send back to (live game/choose the play screen). Further, the correct chosen play may include a green check that may be received by the user and points tallied to the leaderboard that may be received by the user. Further, the incorrect chosen play may include a red X that may be received by a user, a user, and an actual answer. Further, the voids may include a catcher interference and a foul.

Further, the "You Call the Play" may include a loading screen of a live game. Further, the loading screen may include API fun facts that may be placed on the loading screen.

Further, the "You Call the Play" may include ads screen. Further, the ads screen may include a banner advertisement that may be placed strategically on certain pages, a rewarded video advertisement that may be watched to earn points/tokens, a rich media advertisement that may be incorporated as packages for sponsors/corporate partners, a native advertisement that may be used as incentives for universal rewards.

Figure 13:
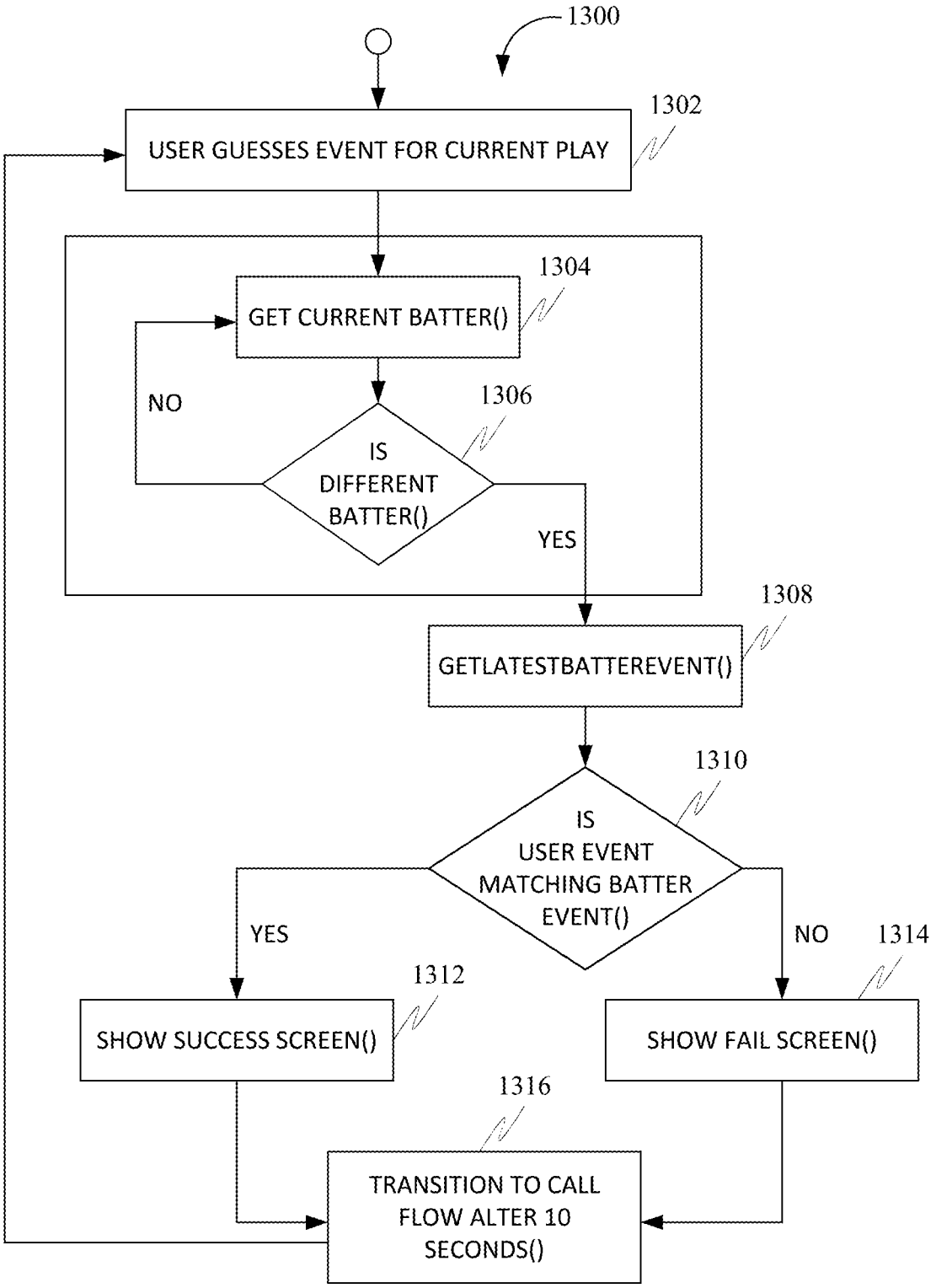
FIG. 13 is a flowchart of a method to facilitate a play event for a "you call the play" application, in accordance with some embodiments.

FIG. 13 is a flowchart of a method 1300 to facilitate a play event for a "you call the play" application, in accordance with some embodiments. Further, at 1302, the method 1300 may include a step of a user guessing an event for a current play. At 1304, the method 1300 may include a step of receiving current batter associated with the current play. Further, at 1306, the method 1300 may include a step of determining whether a batter may be different. If the batter is not different then the method 1300 may include the step 1304 of receiving current batter associated with the current play. If the batter is different, then the method 1300 may include a step 1308 of receiving latest batter event. Further, at 1310, the method 1300 may include a step of determining whether user event may match batter event. If the user event matches with the batter event, then the method 1300 may include a step 1312 of displaying a success screen. If the user event does not match with the batter event, then the method 1300 may include a step 1314 of displaying a fail screen. Further, the method 1300 may include a step 1316 of transitioning to call flow after 10 seconds. Further, the method may include the step of the user guessing an event for the current play.

Figure 14:
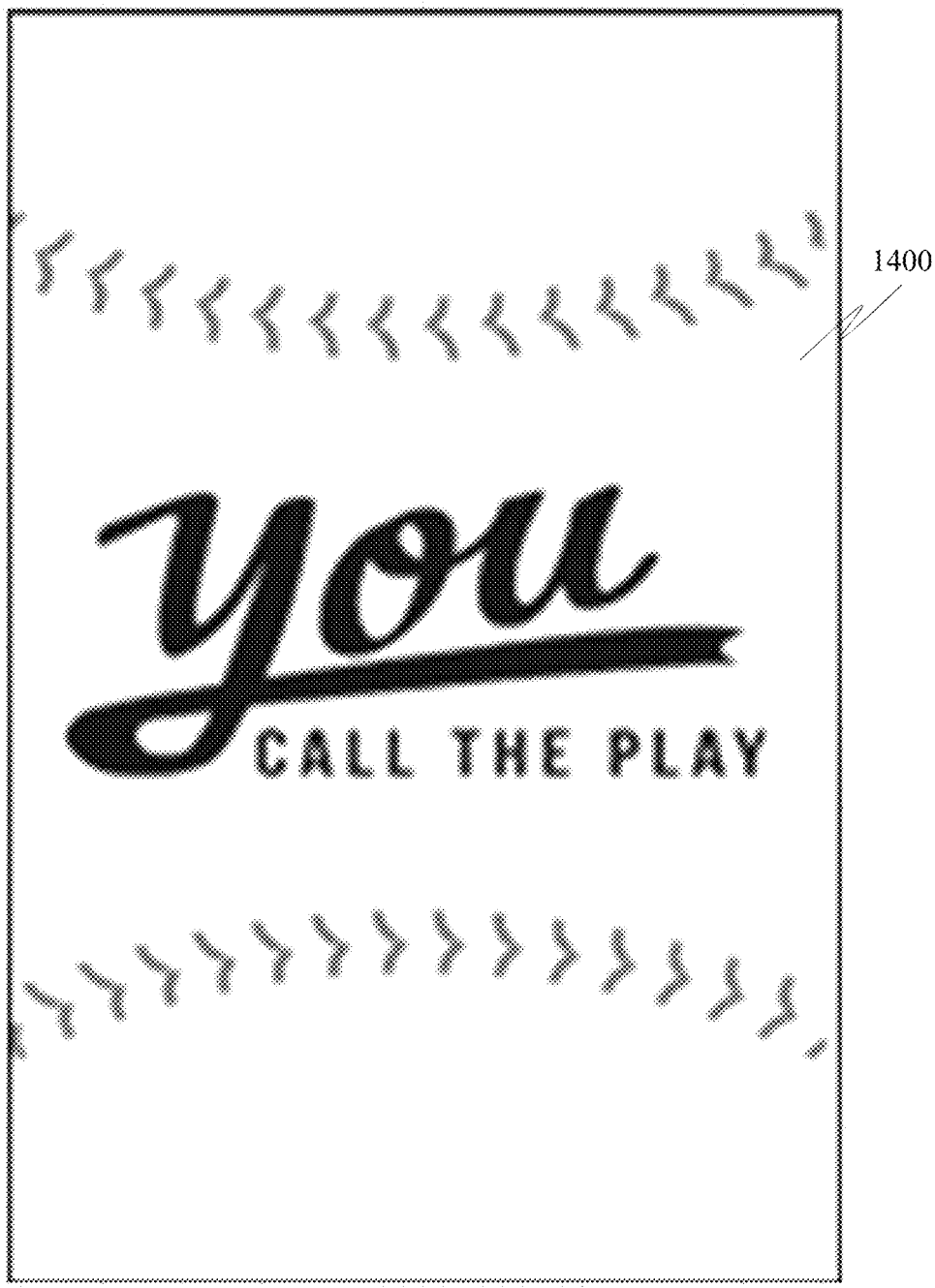
FIG. 14 is a screenshot of a loading user interface of a "you call the play" application, in accordance with some embodiments.

FIG. 14 is a screenshot of a loading user interface 1400 of a "you call the play" application, in accordance with some embodiments.

Figure 15:
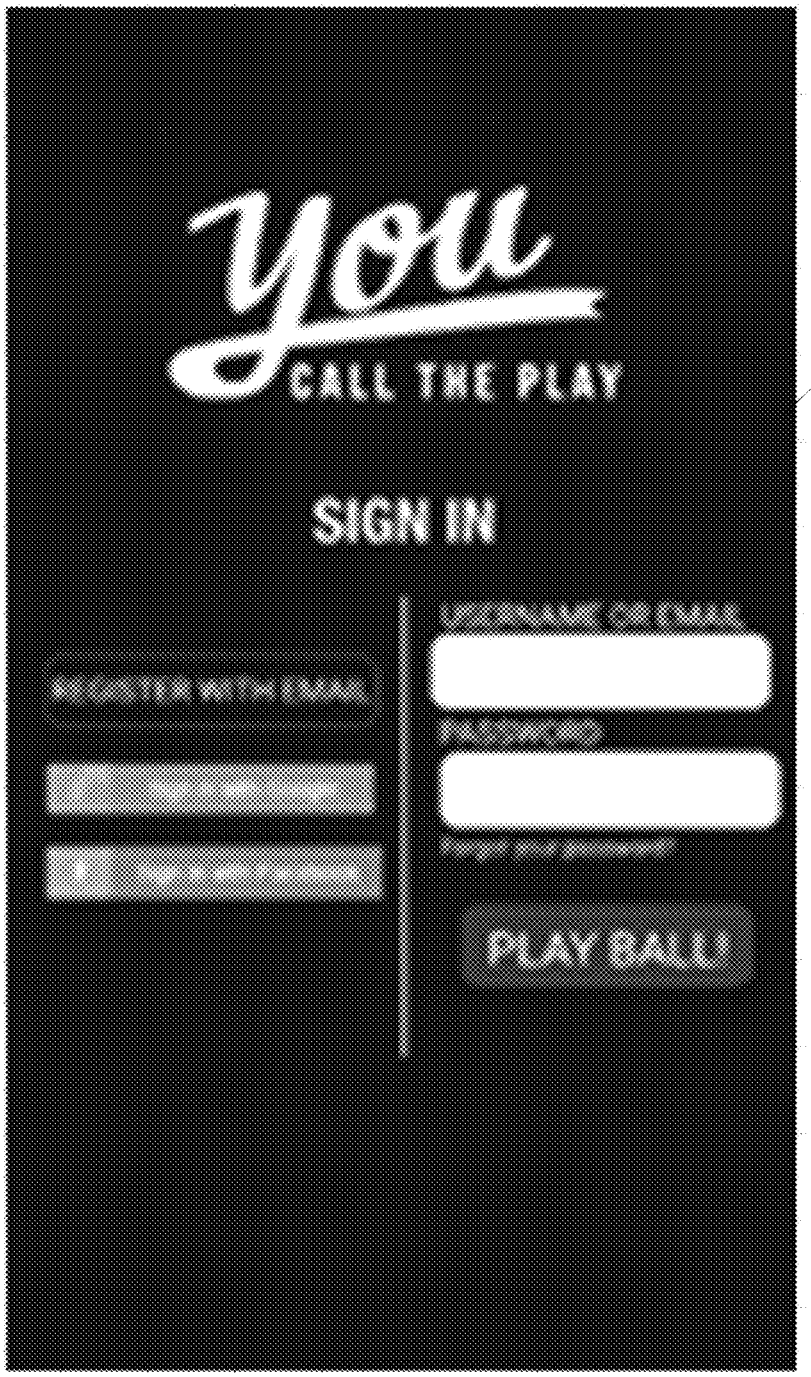
FIG. 15 is a screenshot of an application login user interface of the "you call the play" application, in accordance with some embodiments.

FIG. 15 is a screenshot of an application login user interface 1500 of the "you call the play" application, in accordance with some embodiments.

Figure 16:
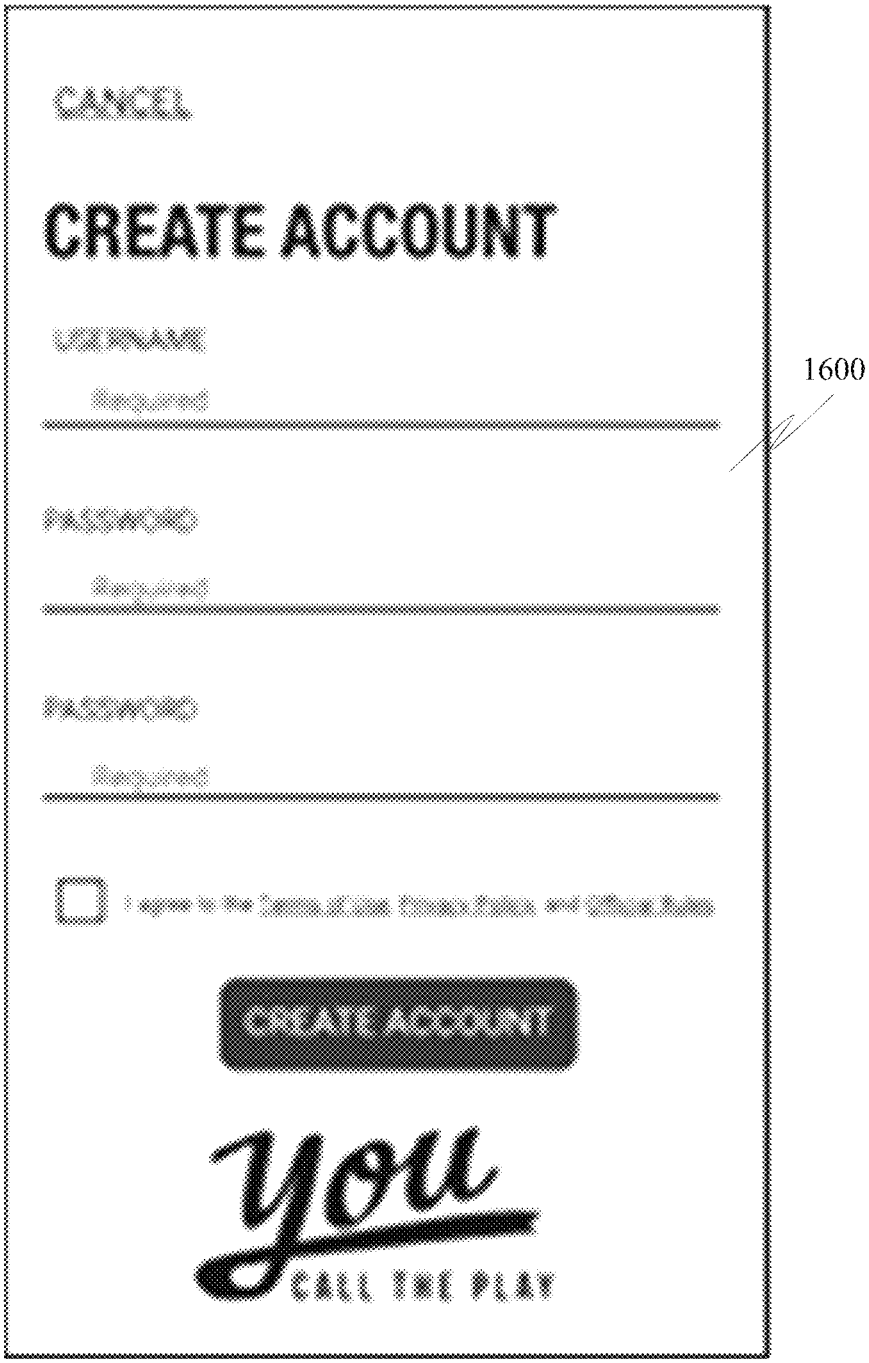
FIG. 16 is a screenshot of a create an account user interface of the "you call the play" application, in accordance with some embodiments.

FIG. 16 is a screenshot of a create an account user interface 1600 of the "you call the play" application, in accordance with some embodiments.

Figure 17:
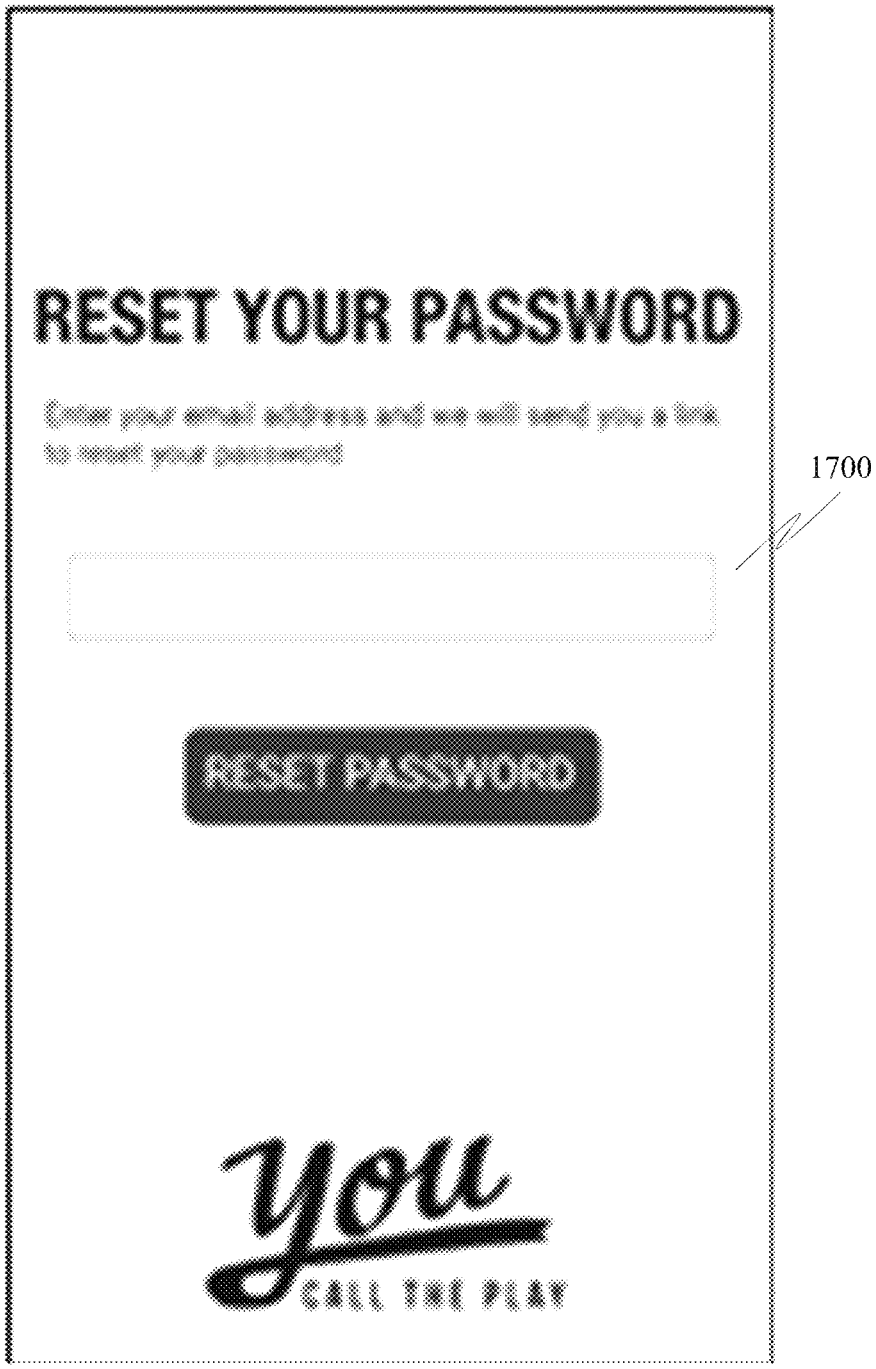
FIG. 17 is a screenshot of a reset password user interface of the "you call the play" application, in accordance with some embodiments.

FIG. 17 is a screenshot of a reset password user interface 1700 of the "you call the play" application, in accordance with some embodiments.

Figure 18:
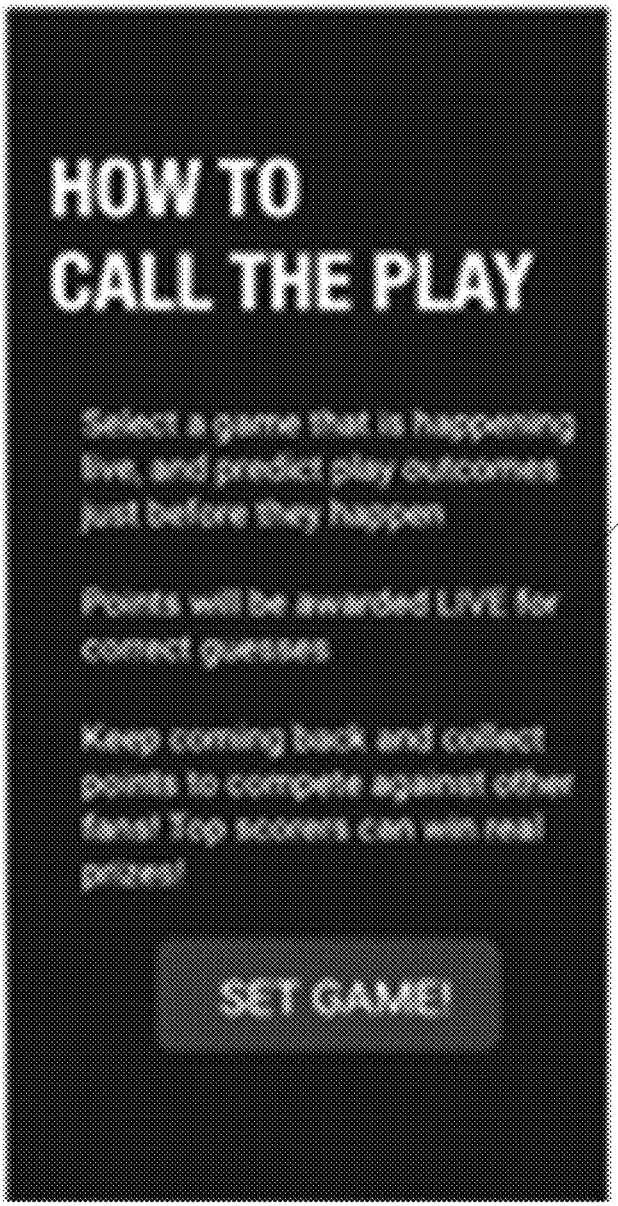
FIG. 18 is a screenshot of an instruction user interface of the "you call the play" application, in accordance with some embodiments.

FIG. 18 is a screenshot of an instruction user interface 1800 of the "you call the play" application, in accordance with some embodiments.

Figure 19:
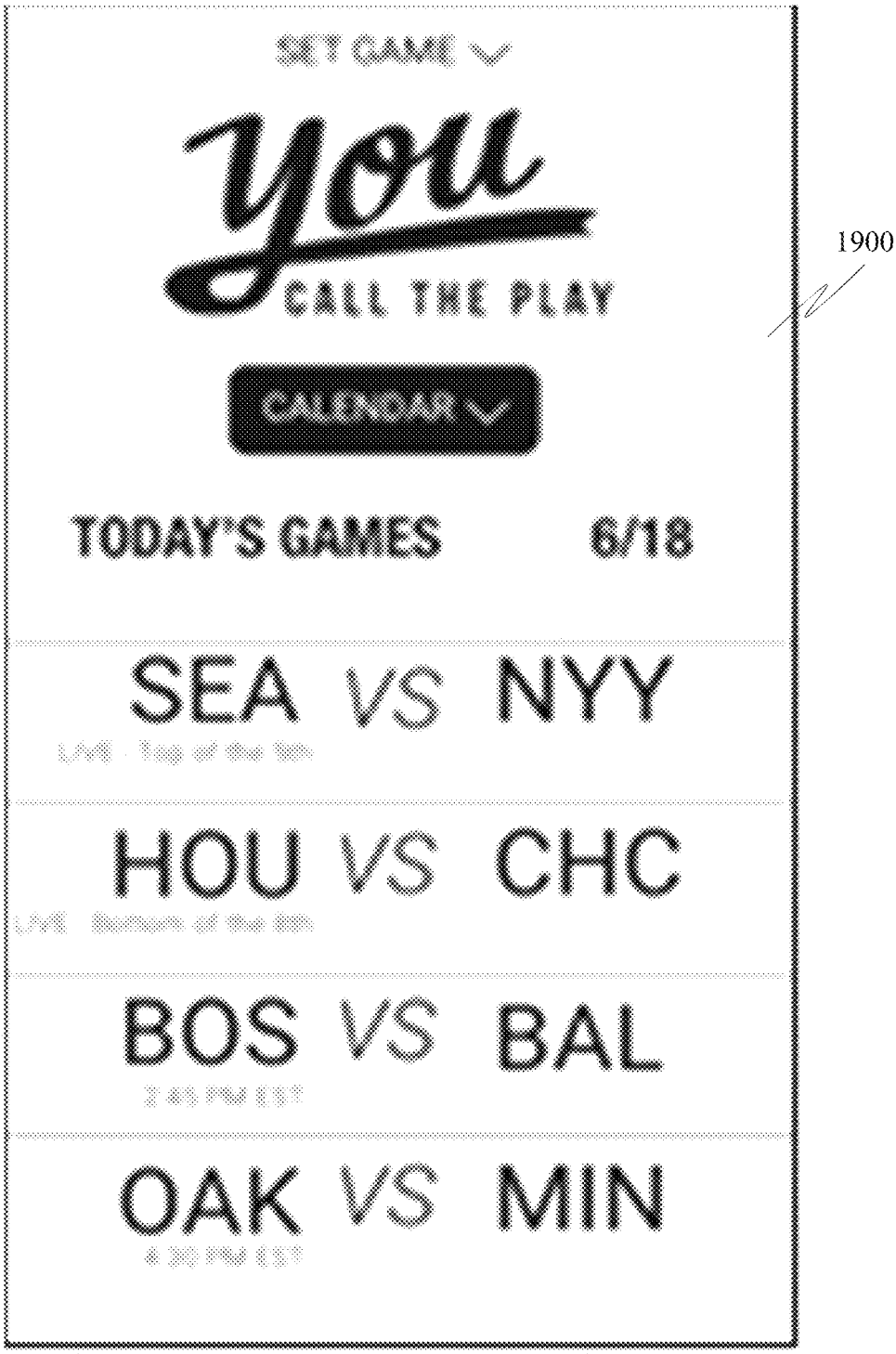
FIG. 19 is a screenshot of an application main user interface of the "you call the play" application, in accordance with some embodiments.

FIG. 19 is a screenshot of an application main user interface 1900 of the "you call the play" application, in accordance with some embodiments.

Figure 20:
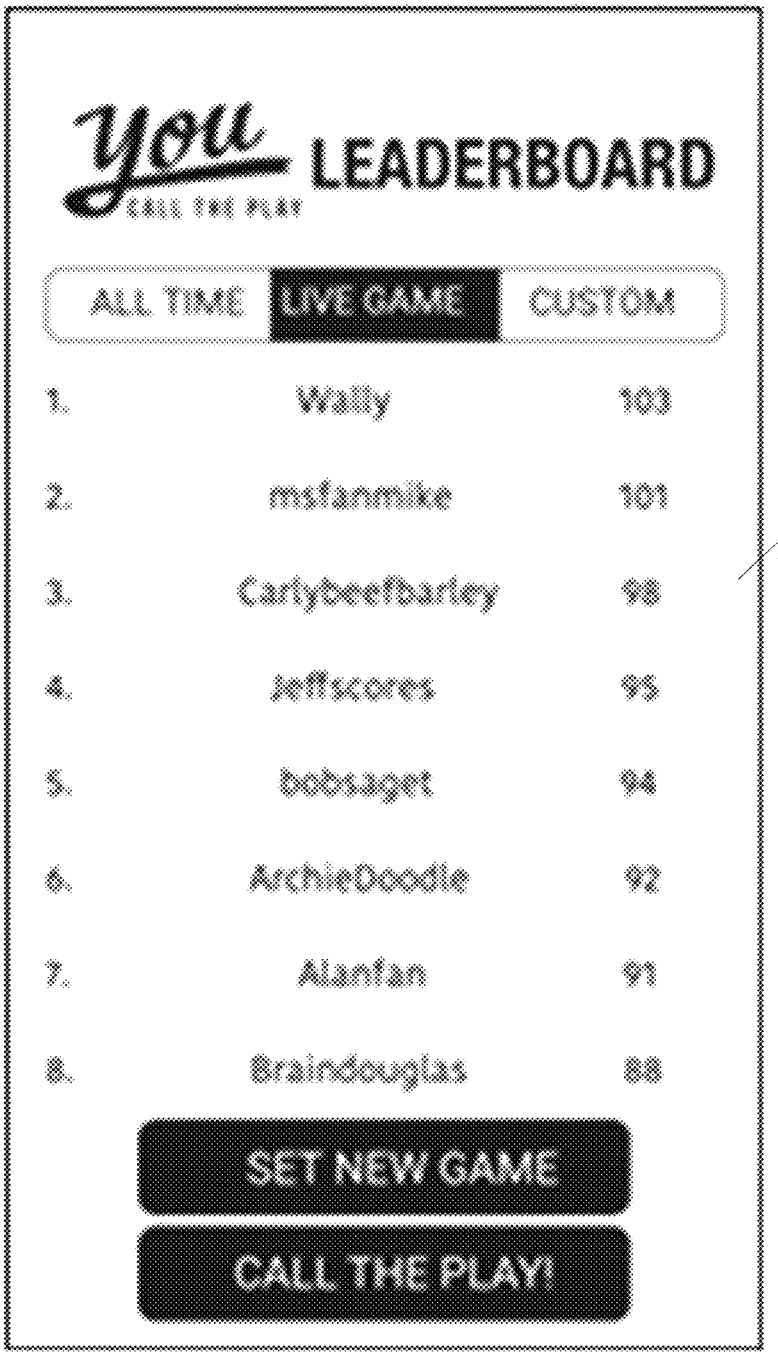
FIG. 20 is a screenshot of an application leaderboard user interface of the "you call the play" application, in accordance with some embodiments.

FIG. 20 is a screenshot of an application leaderboard user interface 2000 of the "you call the play" application, in accordance with some embodiments.

FIG. 21 is a screenshot of a predictive play-calling user interface 2100 of the "you call the play" application, in accordance with some embodiments.

FIG. 22 is a screenshot of a predictive play-calling result user interface 2200 of the "you call the play" application, in accordance with some embodiments.

Figure 23:
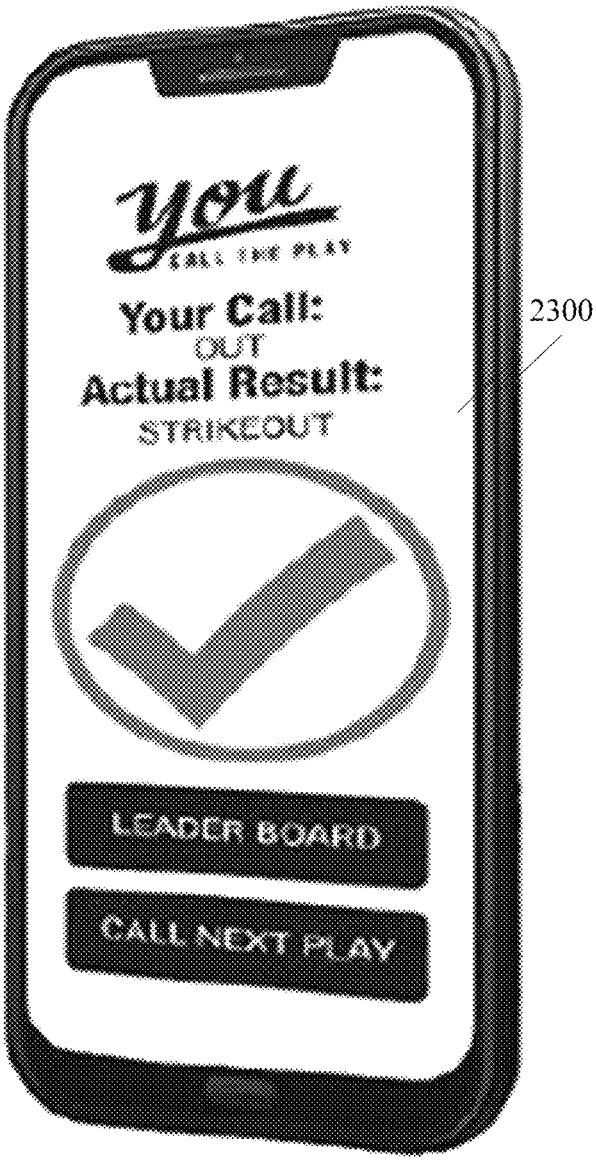
FIG. 23 shows screenshots of a predictive play-calling result user interface of the "you call the play" application, in accordance with some embodiments.

FIG. 23 shows screenshots of a predictive play-calling result user interface 2300 of the "you call the play" application, in accordance with some embodiments.

Figure 24:
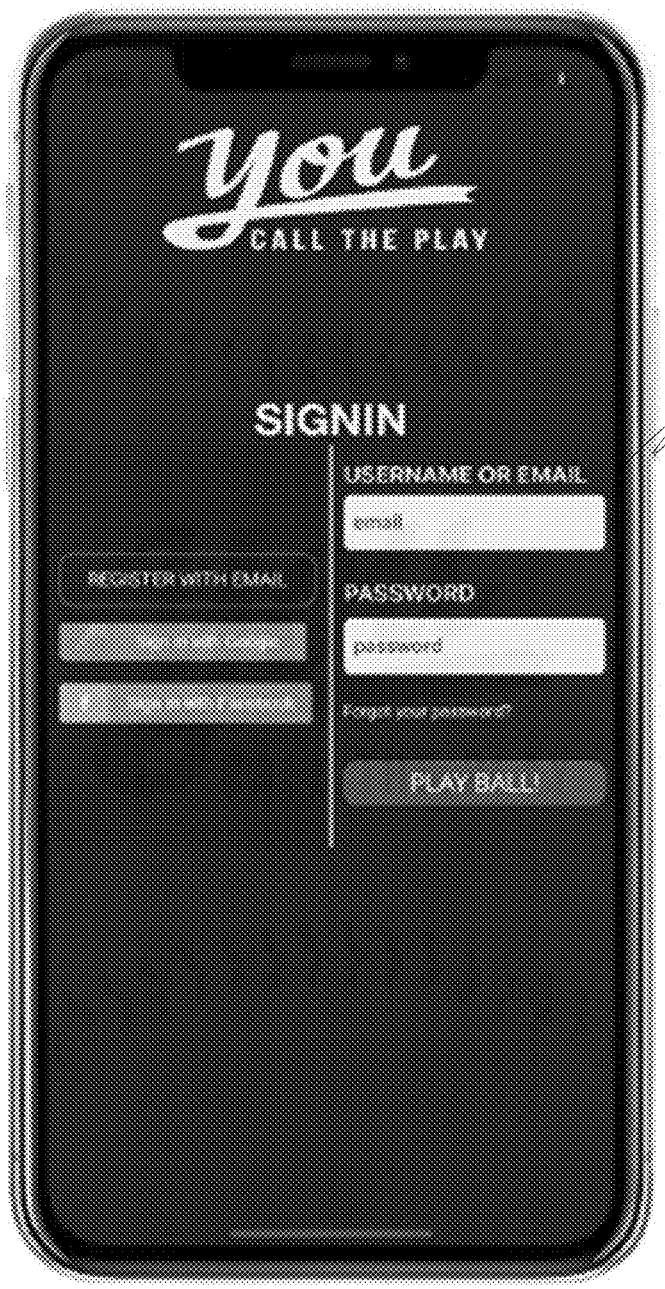
FIG. 24 is a screenshot of a sign in user interface of the "you call the play" application, in accordance with some embodiments.

FIG. 24 is a screenshot of a sign in user interface 2400 of the "you call the play" application, in accordance with some embodiments.

Figure 25:
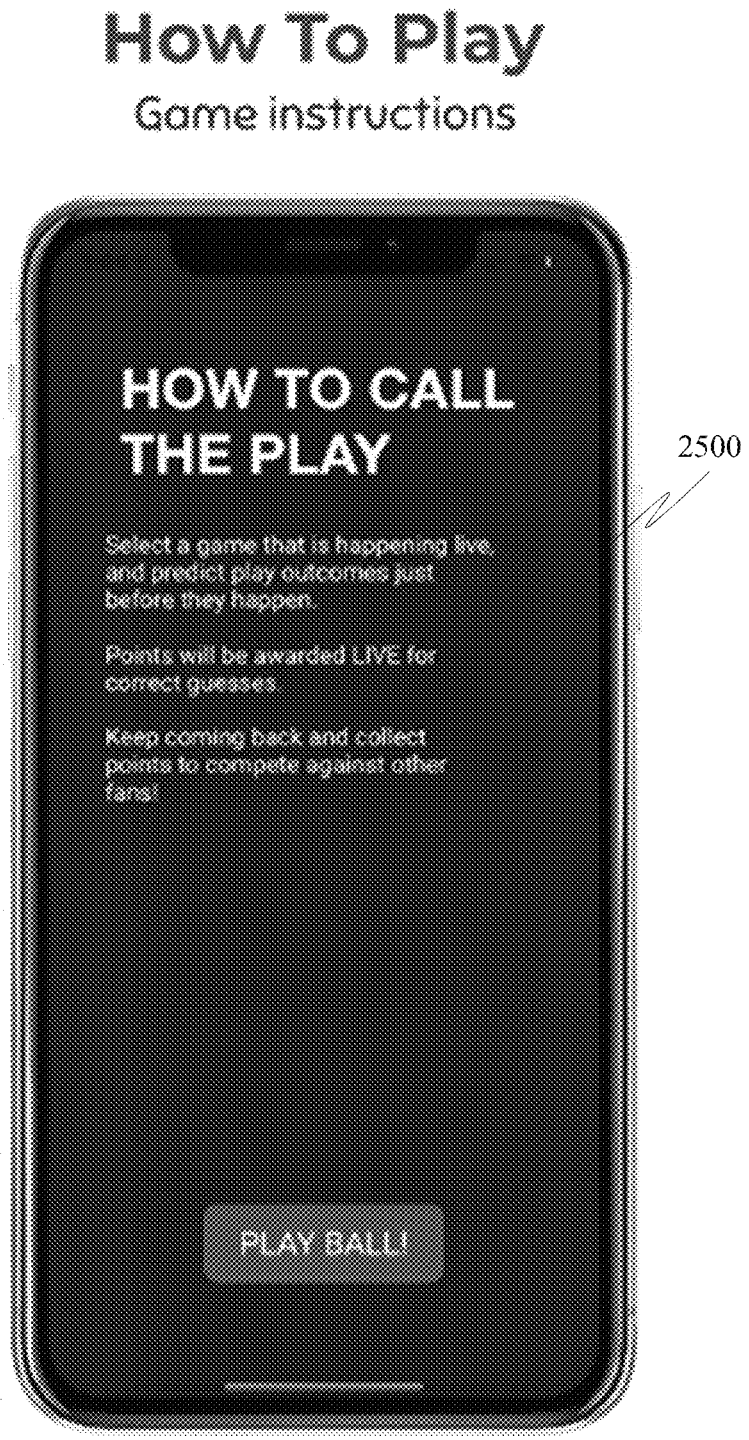
FIG. 25 is a screenshot of an instruction user interface of the "you call the play" application, in accordance with some embodiments.

FIG. 25 is a screenshot of an instruction user interface 2500 of the "you call the play" application, in accordance with some embodiments.

Figure 26:
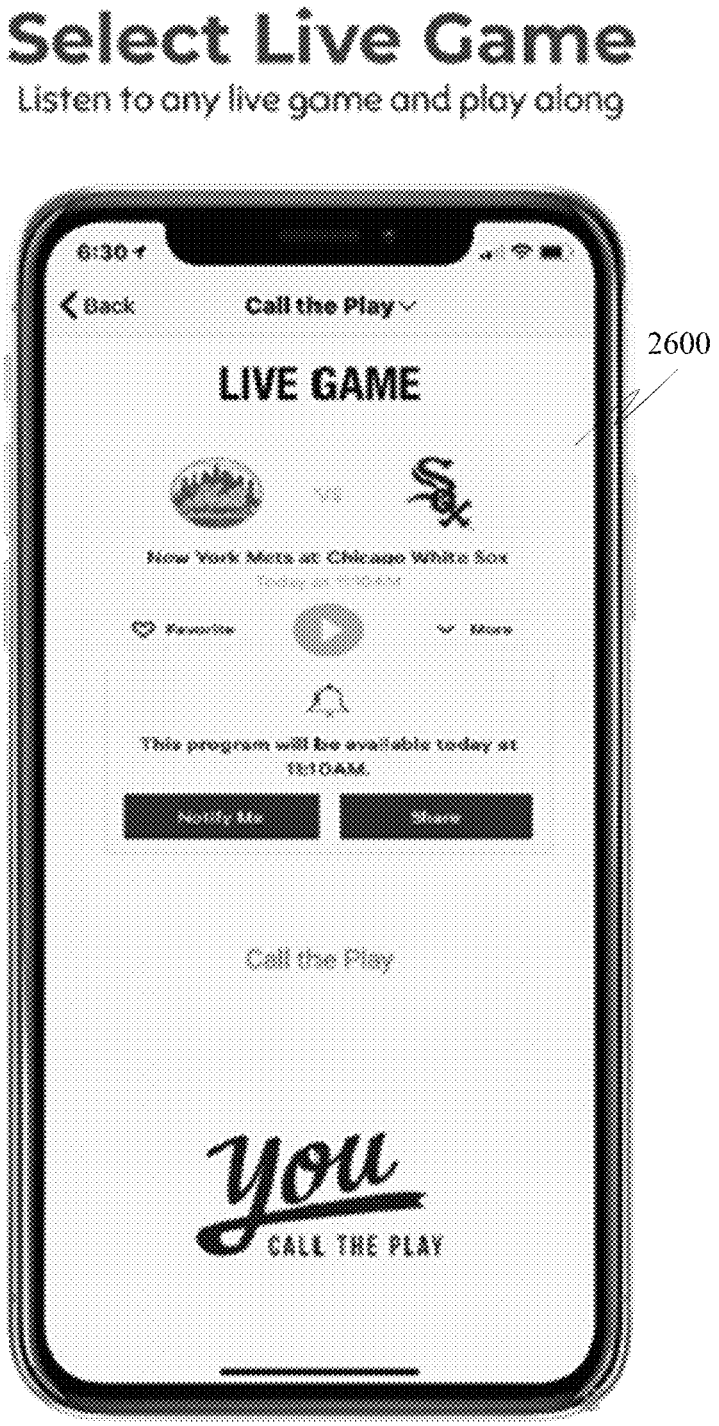
FIG. 26 is a screenshot of a live game user interface of the "you call the play" application, in accordance with some embodiments.

FIG. 26 is a screenshot of a live game user interface 2600 of the "you call the play" application, in accordance with some embodiments.

Figure 27:
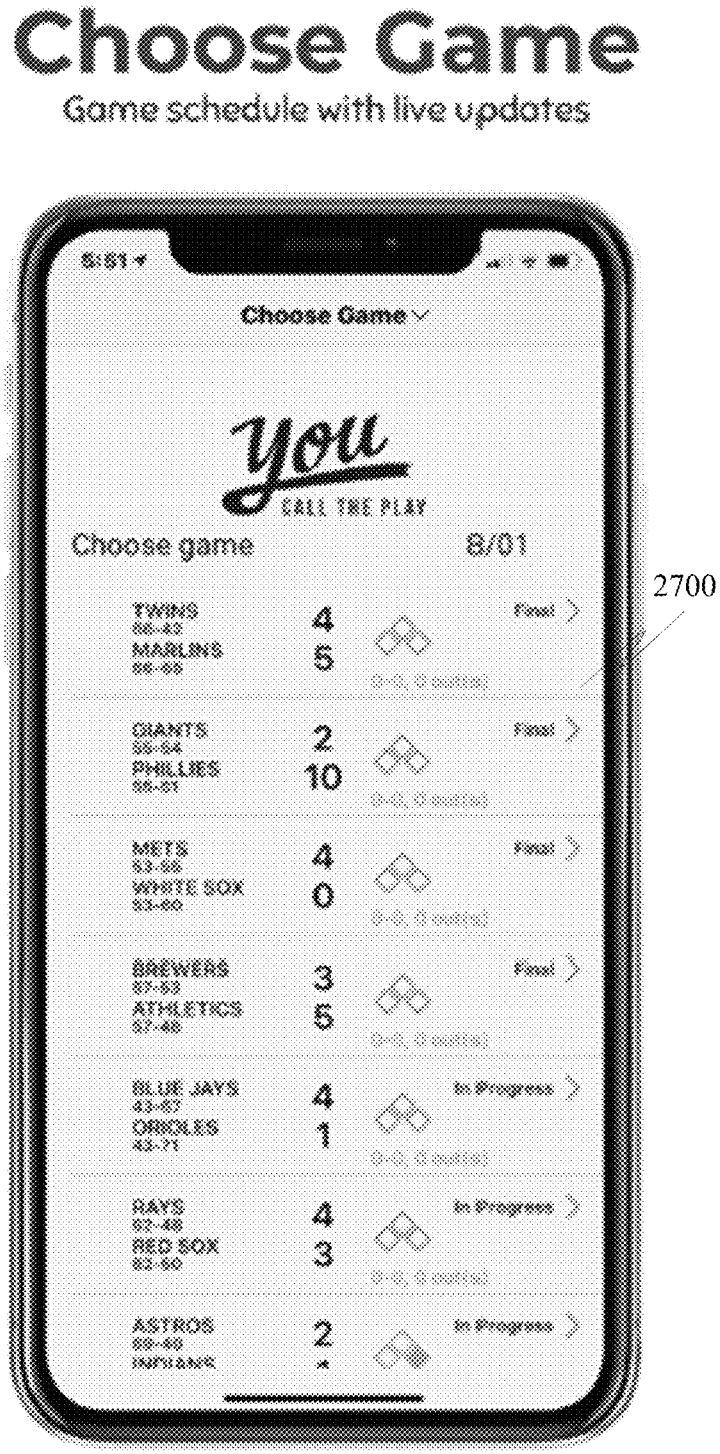
FIG. 27 is a screenshot of a choose game user interface of the "you call the play" application, in accordance with some embodiments.

FIG. 27 is a screenshot of a choose game user interface 2700 of the "you call the play" application, in accordance with some embodiments.

FIG. 28 is a screenshot of a call the play user interface 2800 of the "you call the play" application, in accordance with some embodiments.

Figure 29:
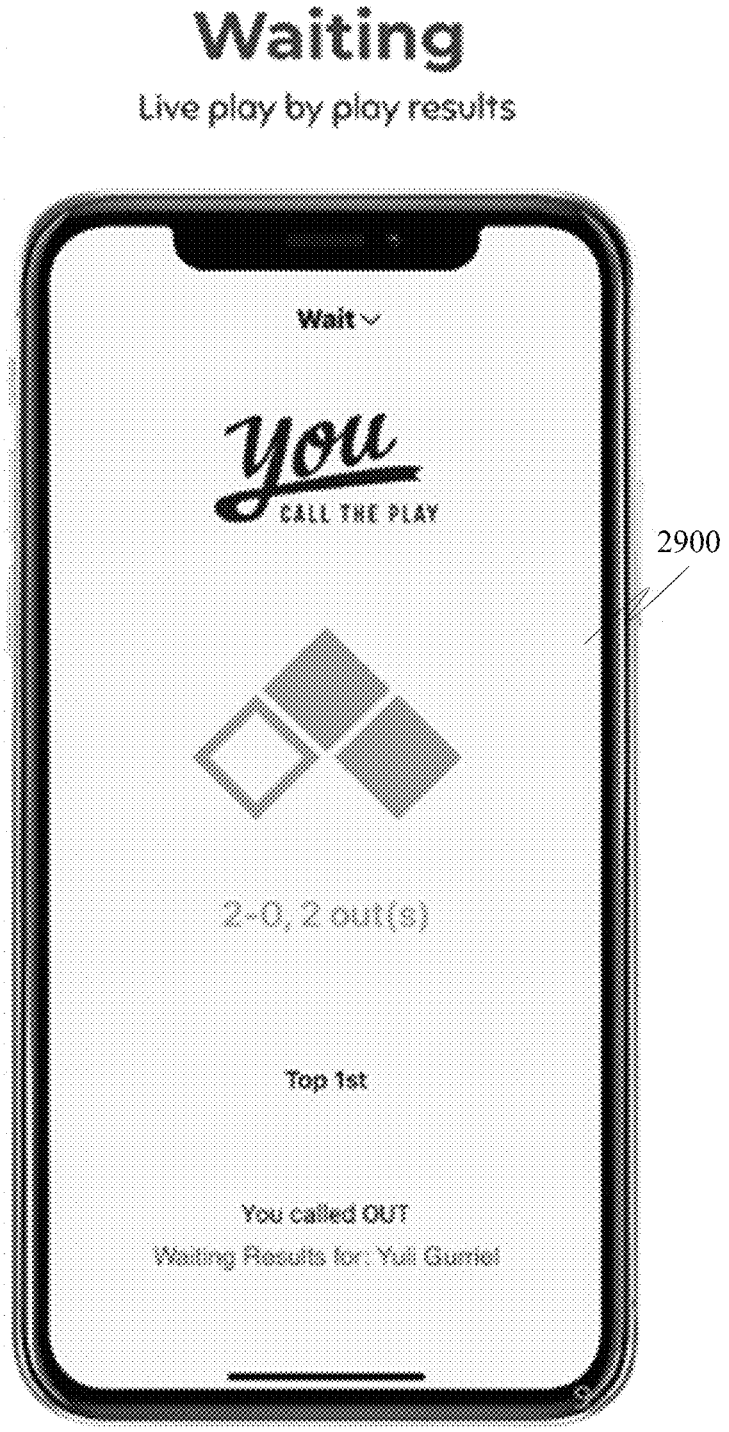
FIG. 29 is a screenshot of a wait user interface of the "you call the play" application, in accordance with some embodiments.

FIG. 29 is a screenshot of a wait user interface 2900 of the "you call the play" application, in accordance with some embodiments.

Figure 30:
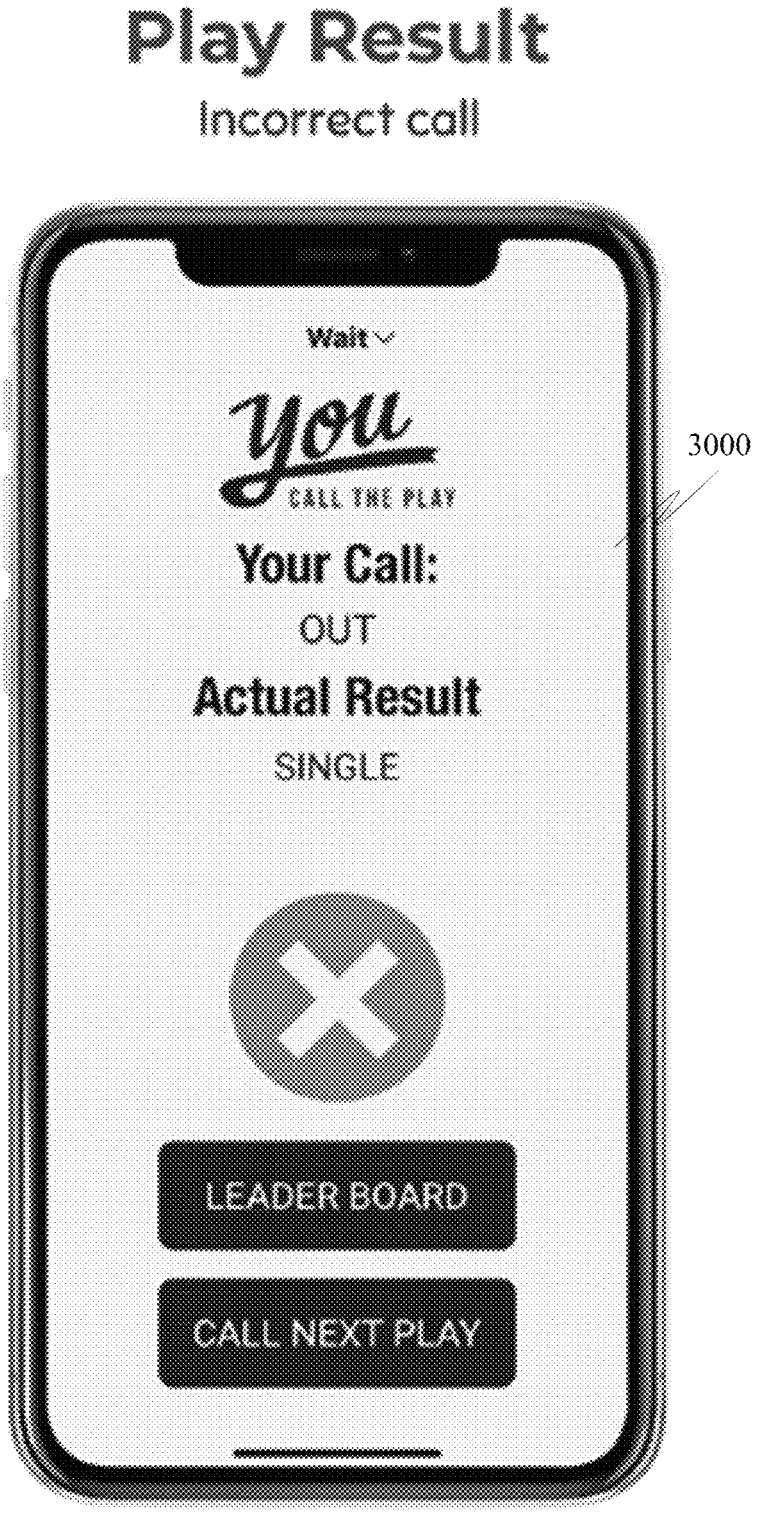
FIG. 30 is a screenshot of an incorrect call of play result user interface of the "you call the play" application, in accordance with some embodiments.

FIG. 30 is a screenshot of an incorrect call of play result user interface 3000 of the "you call the play" application, in accordance with some embodiments.

FIG. 31 is a screenshot of a correct call of play result user interface 3100 of the "you call the play" application, in accordance with some embodiments.

Figure 32:
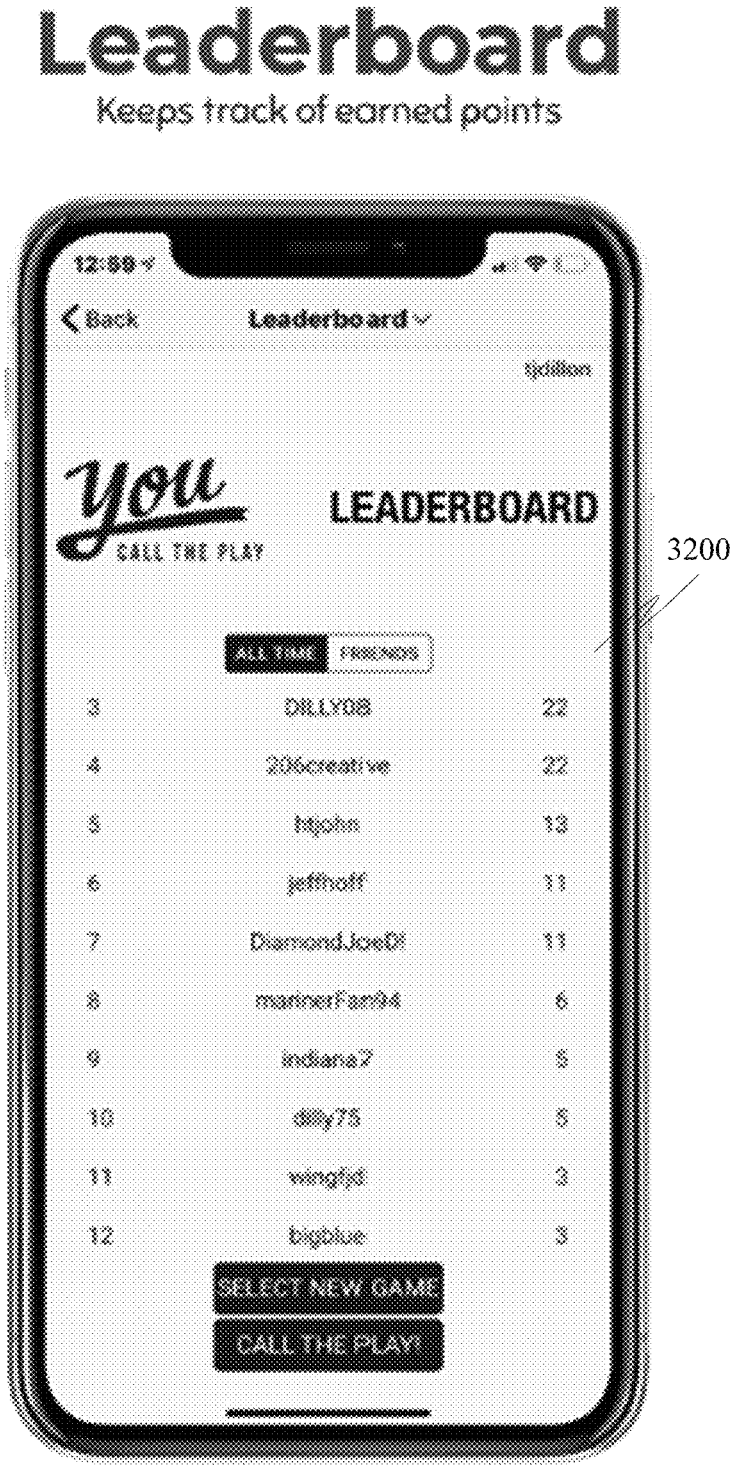
FIG. 32 is a screenshot of a leaderboard user interface of the "you call the play" application, in accordance with some embodiments.

FIG. 32 is a screenshot of a leaderboard user interface 3200 of the "you call the play" application, in accordance with some embodiments.

Figure 33:
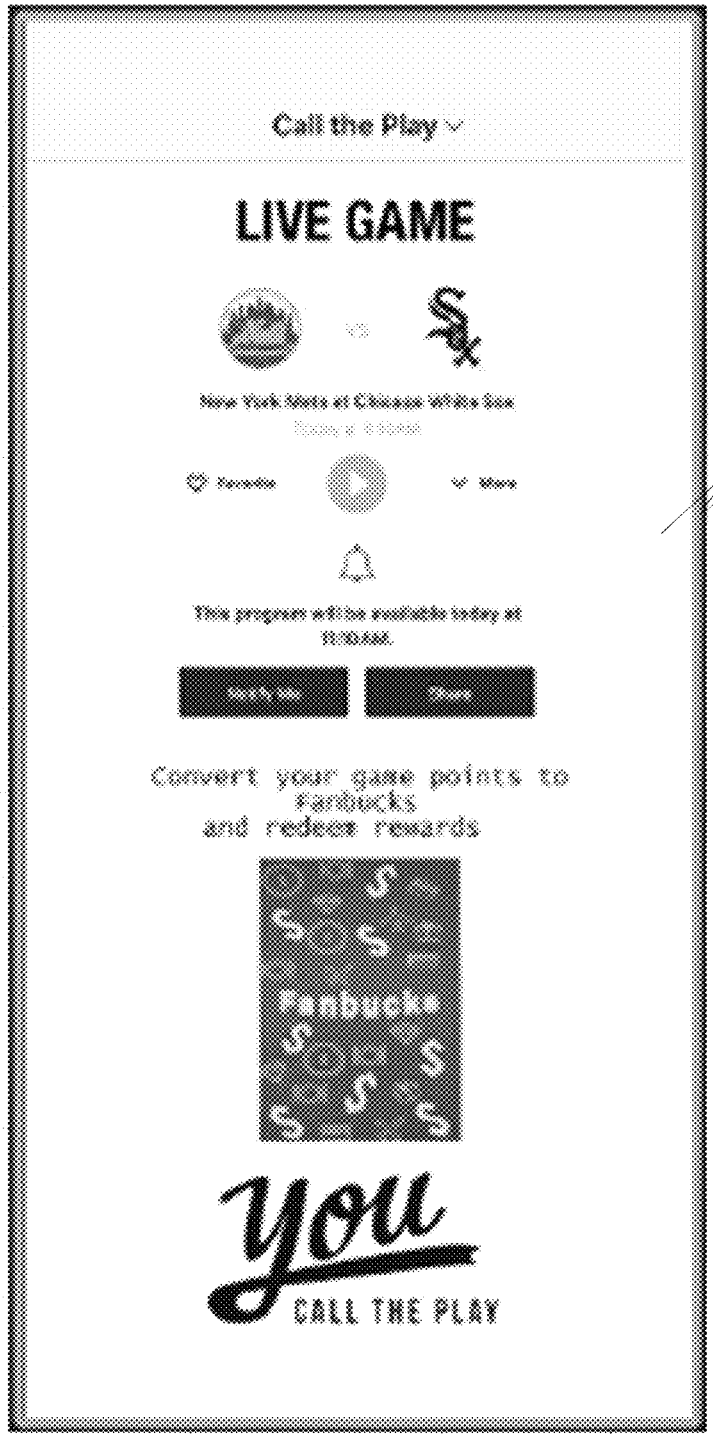
FIG. 33 is a screenshot of a call the play user interface of the "you call the play" application, in accordance with some embodiments.

FIG. 33 is a screenshot of a call the play user interface 3300 of the "you call the play" application, in accordance with some embodiments.

Figure 34:
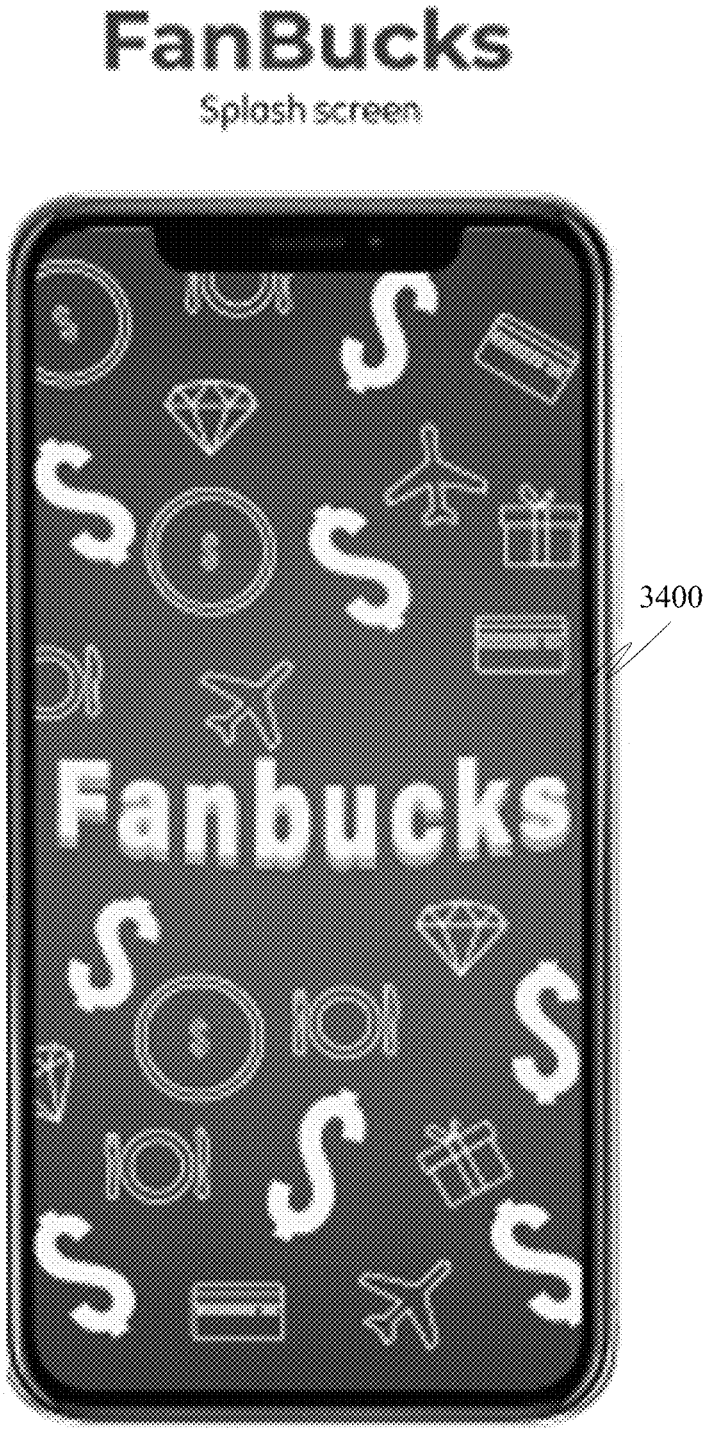
FIG. 34 is a screenshot of a splash user interface of a "Fanbucks" application, in accordance with some embodiments.

FIG. 34 is a screenshot of a splash user interface 3400 of a "Fanbucks" application, in accordance with some embodiments.

Figure 35:
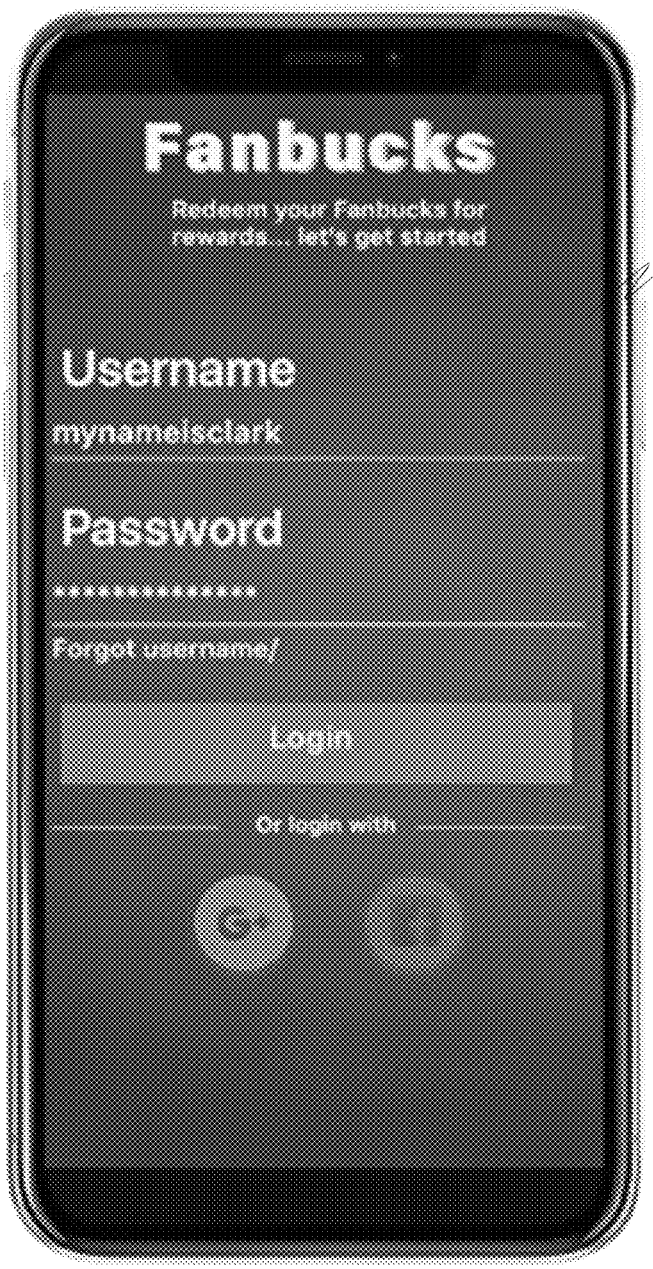
FIG. 35 is a screenshot of a login user interface of the "Fanbucks" application, in accordance with some embodiments.

FIG. 35 is a screenshot of a login user interface 3500 of the "Fanbucks" application, in accordance with some embodiments.

Figure 36:
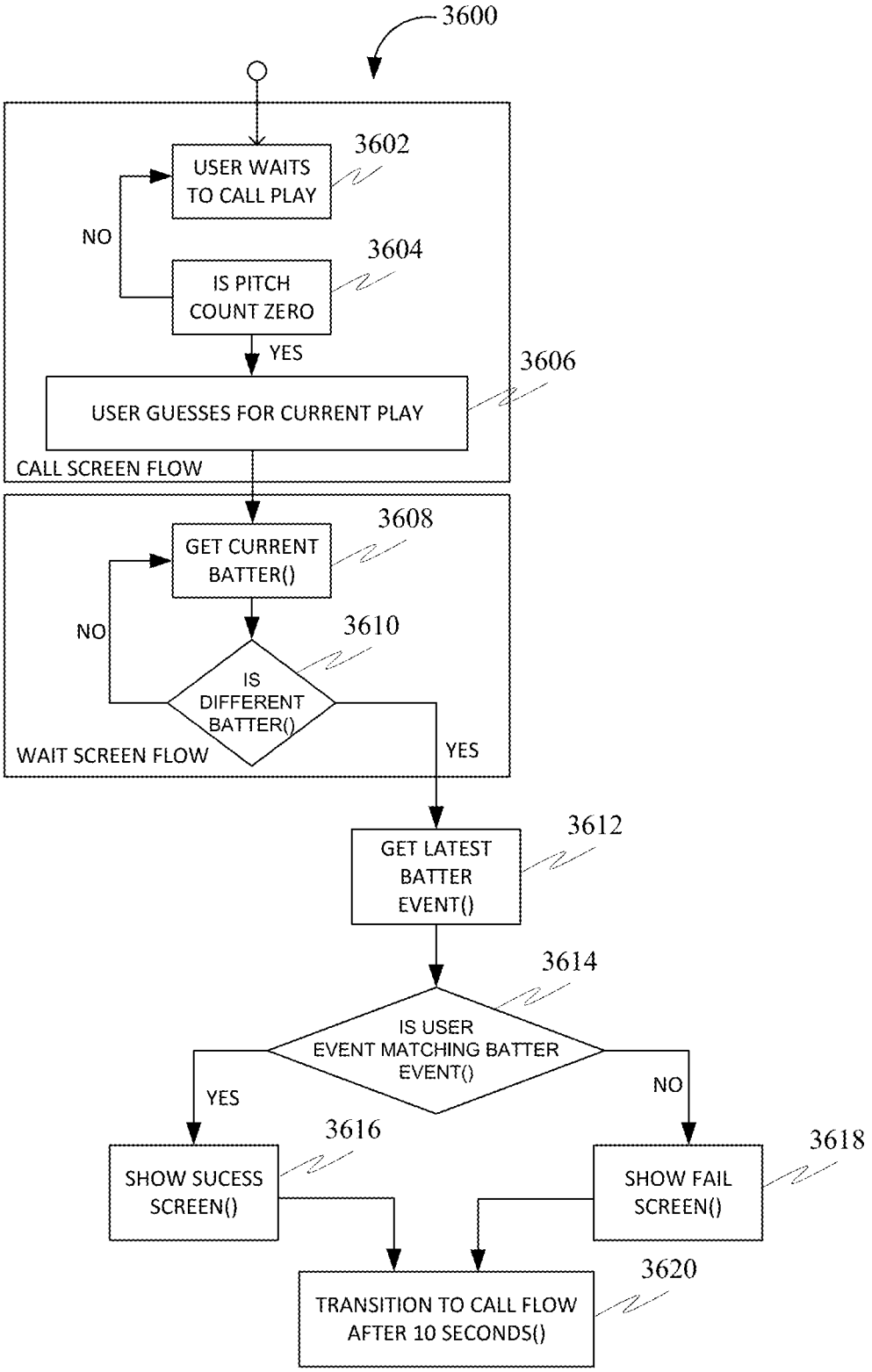
FIG. 36 is a flowchart of a method to facilitate a play event for a "you call the play" application, in accordance with some embodiments.

FIG. 36 is a flowchart of a method 3600 to facilitate a play event for a "you call the play" application, in accordance with some embodiments. Accordingly, at 3602, the method 3600 may include a step of receiving user's call waiting to play a current play. Further, at 3604, the method 3600 may include a step of determining whether a pitch count is zero. If the pitch count not zero then the method 3600 may include a step of 3602 of receiving the user's call waiting to play. Further, at 3606, the method 3600 may include a step of a user guessing an event for the current play. At 3608, the method 3600 may include a step of receiving current batter associated with the current play. Further, at 3610, the method 3600 may include a step of determining whether a batter may be different. If the batter is not different then the method 3600 may include the step 3608 of receiving current batter associated with the current play. If the batter is different, then the method 3600 may include a step 3612 of receiving latest batter event. Further, at 3614, the method 3600 may include a step of determining whether user event may match batter event. If the user event matches with the batter event, then the method 3600 may include a step 3616 of displaying a success screen. If the user event does not match with the batter event, then the method 3600 may include a step 3618 of displaying a fail screen. Further, the method 3600 may include a step 3620 of transitioning to call flow after 10 seconds. Further, the method may include the step of the user guessing an event for the current play.

Figure 37:
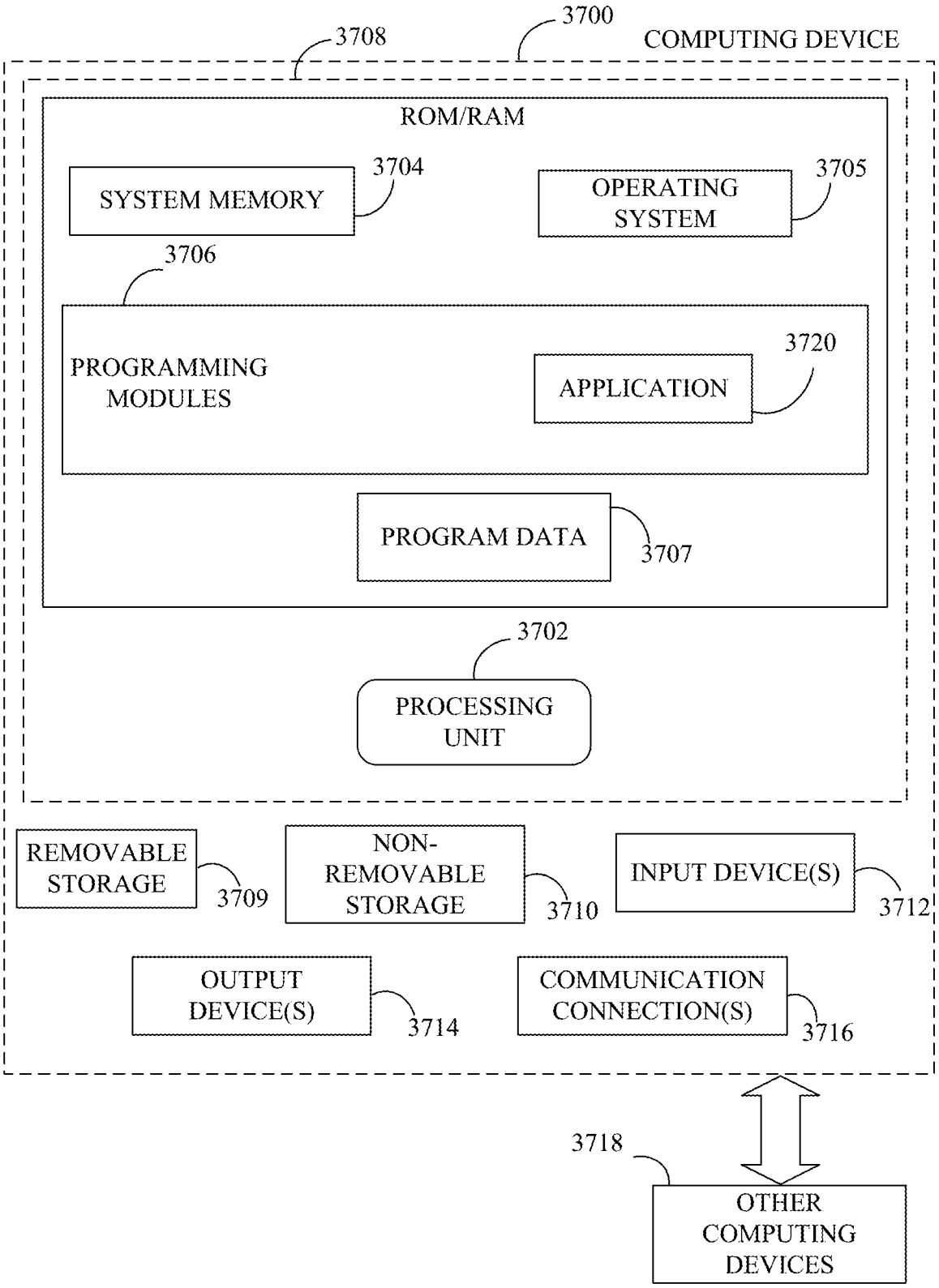
FIG. 37 is a block diagram of a computing device for implementing the methods disclosed herein, in accordance with some embodiments.

With reference to FIG. 37, a system consistent with an embodiment of the disclosure may include a computing device or cloud service, such as computing device 3700. In a basic configuration, computing device 3700 may include at least one processing unit 3702 and a system memory 3704. Depending on the configuration and type of computing device, system memory 3704 may comprise, but is not limited to, volatile (e.g. random-access memory (RAM)), non-volatile (e.g. read-only memory (ROM)), flash memory, or any combination. System memory 3704 may include operating system 3705, one or more programming modules 3706, and may include a program data 3707. Operating system 3705, for example, may be suitable for controlling computing device 3700's operation. In one embodiment, programming modules 3706 may include image-processing module, machine learning module. Furthermore, embodiments of the disclosure may be practiced in conjunction with a graphics library, other operating systems, or any other application program and is not limited to any particular application or system. This basic configuration is illustrated in FIG. 37 by those components within a dashed line 3708.

Computing device 3700 may have additional features or functionality. For example, computing device 3700 may also include additional data storage devices (removable and/or non-removable) such as, for example, magnetic disks, optical disks, or tape. Such additional storage is illustrated in FIG. 37 by a removable storage 3709 and a non-removable storage 3710. Computer storage media may include volatile and non-volatile, removable and non-removable media implemented in any method or technology for storage of information, such as computer-readable instructions, data structures, program modules, or other data. System memory 3704, removable storage 3709, and non-removable storage 3710 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 3700. Any such computer storage media may be part of device 3700. Computing device 3700 may also have input device(s) 3712 such as a keyboard, a mouse, a pen, a sound input device, a touch input device, a location sensor, a camera, a biometric sensor, etc. Output device(s) 3714 such as a display, speakers, a printer, etc. may also be included. The aforementioned devices are examples and others may be used.

Computing device 3700 may also contain a communication connection 3716 that may allow device 3700 to communicate with other computing devices 3718, such as over a network in a distributed computing environment, for example, an intranet or the Internet. Communication connection 3716 is one example of communication media. Communication media may typically be embodied by computer-readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer-readable media as used herein may include both storage media and communication media.

As stated above, a number of program modules and data files may be stored in system memory 3704, including operating system 3705. While executing on processing unit 3702, programming modules 3706 (e.g., application 3720 such as a media player) may perform processes including, for example, one or more stages of methods, algorithms, systems, applications, servers, databases as described above. The aforementioned process is an example, and processing unit 3702 may perform other processes. Other programming modules that may be used in accordance with embodiments of the present disclosure may include machine learning applications.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general-purpose graphics processor-based systems, multiprocessor systems, microprocessor-based or programmable consumer electronics, application-specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer-readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid-state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Although the present disclosure has been explained in relation to its preferred embodiment, it is to be understood that many other possible modifications and variations can be made without departing from the spirit and scope of the disclosure.

The following is claimed:

1. A method for facilitating betting in a game, the method comprising:

capturing sensor data from at least one game sensor associated with at least one game;

generating game data based on the sensor data, wherein the game data includes a description of events occurring in the game;

analyzing, using a processing device, the game data;

identifying, using the processing device, an occurrence of a betting event in the description of events based on the analyzing, wherein the betting event is associated with an anticipated live event in the at least one game;

generating a plurality of options associated with an outcome of the betting event, wherein the plurality of options is based on possible outcomes of the live event;

generating betting odds corresponding with the plurality of options, wherein the betting odds are based on a statistical data and the game data;

generating a time span that concludes prior to the live event, wherein the time span is 10 seconds or less;

transmitting, using the communication device, the plurality of options associated with an outcome of the betting event to at least one participant device associated with at least one participant;

receiving, using the communication device, an option indication corresponding to an option of the plurality of options from the at least one participant device;

validating whether the option indication was received prior to the conclusion of the time span;

receiving, using the communication device, at least one participant data associated with the at least one participant from at least one participant sensor, wherein the at least one participant sensor is configured to generate the at least one participant data;

receiving, using the communication device, an actual outcome of the betting event from the at least one game sensor;

comparing, using the processing device, the option indication and the actual outcome;

determining, using the processing device, at least one response based on the comparing;

analyzing, using the processing device, the option indication and the at least one participant data associated with the at least one participant;

generating, using the processing device, at least one engagement data based on analyzing the option indication and the at least one participant data, wherein the at least one engagement data is associated with the engagement of the at least one participant with the at least one game, wherein the determining of the at least one response is based on the at least one engagement data;

transmitting, using the communication device, the at least one response to the at least one participant device;

determining, using the processing device, at least one target participant among the at least one participant based on the engagement data and analyzing the option indication and the at least one participant data;

selectively transmitting, using the communication device, advertisement data to the at least one target participant among the among the at least one participant; and storing, using a storage device, the at least one response corresponding to the betting event and the betting event in a database.

2. The method of claim 1 further comprising:

analyzing, using the processing device, the at least one response;

determining, using the processing device, one or more points associated with the at least one response based on the analyzing; and transmitting, using the communication device, the one or more points to the at least one participant device.

3. The method of claim 2 further comprising:

generating, using the processing device, a virtual currency associated with the at least one participant, wherein the virtual currency is associated with a plurality of denominations, wherein the plurality of denominations is based on the one or more points; and processing, using the processing device, at least one transaction with at least one participant merchant based on an exchange of the virtual currency against at least one object, wherein the exchange of the virtual currency against the at least one object is done between the at least one participant and the at least one participant merchant.

4. The method of claim 1 further comprising:

receiving, using the communication device, at least one additional game data from the at least one additional game sensor, wherein the at least one additional game sensor is configured to generate the at least one additional game data;

analyzing, using the processing device, the at least one additional game data and the game data; and predicting, using the processing device, the occurrence of the betting event based on the analyzing.

5. The method of claim 1, wherein the at least one participant device comprises at least one companion application associated with the at least one game, wherein the at least one companion application present at least one game information associated with the at least one game, wherein the at least one companion application configured for performing:

transmitting the plurality of options associated with the outcome of the betting event to the at least one participant device; and receiving the option indication corresponding the option from the at least one participant device.

6. The method of claim 1, wherein the at least one participant device comprises at least one broadcast receiver associated with the at least one game, wherein the at least one broadcast receiver is configured for:

transmitting the plurality of options associated with the outcome of the betting event to the at least one participant device; and receiving the option indication corresponding the option from the at least one participant device.

7. The method of claim 1 further comprising:

retrieving, using the storage device, at least one statistical data associated with the at least one game from a database, wherein the database comprises the at least one statistical data;

analyzing, using the processing device, the at least one statistical data and the game data using machine learning;

generating, using the processing device, betting odd data corresponding to the betting event based on the analyzing; and transmitting, using the communication device, the betting odd data to the at least one participant device.

8. A system for facilitating betting in a game, the system comprising:

a communication device configured for:

transmitting a plurality of options associated with an outcome of a betting event to at least one participant device associated with at least one participant;

receiving an option indication corresponding to an option of the plurality of options from the at least one participant device during a time span;

receiving, using the communication device, at least one participant data associated with the at least one participant from at least one participant sensor, wherein the at least one participant sensor is configured to generate the at least one participant data;

receiving an actual outcome of the betting event from the at least one game sensor;

transmitting at least one response to the at least one participant device; and selectively transmitting, using the communication device, advertisement data to the at least one target participant among the among the at least one participant;

a processing device configured for:

capturing sensor data from at least one game sensor associated with at least one game;

generating game data based on the sensor data, wherein the game data includes a description of events occurring in the at least one game;

analyzing the game data;

identifying an occurrence of the betting event in the description of events based on the analyzing, wherein the betting event is associated with an anticipated live event in the at least one game;

generating a plurality of options associated with an outcome of the betting event, wherein the plurality of options is based on possible outcomes of the live event;

generating betting odds corresponding with the plurality of options, wherein the betting odds are based on a statistical data and the game date;

generating a time span that concludes prior to the live event, wherein the time span is 10 seconds or less;

validating whether the option indication was received prior to the conclusion of the time span;

comparing the option indication and the actual outcome;

determining the at least one response based on the comparing;

analyzing, using the processing device, the option indication and the at least one participant data associated with the at least one participant;

generating, using the processing device, at least one engagement data based on analyzing the option indication and the at least one participant data, wherein the at least one engagement data is associated with the engagement of the at least one participant with the at least one game, wherein the determining of the at least one response is based on the at least one engagement data; and determining, using the processing device, at least one target participant among the at least one participant based on the engagement data and analyzing the option indication and the at least one participant data; and a storage device configured for storing the at least response corresponding to the betting event and the betting event in a database.

9. The system of claim 8, wherein the processing device is further configured for:

analyzing the at least one response;

determining one or more points associated with the at least one response based on the analyzing, wherein the communication device is further configured for transmitting the one or more points to the at least one participant device.

10. The system of claim 9, wherein the processing device is further configured for:

generating a virtual currency associated with the at least one participant, wherein the virtual currency is associated with a plurality of denominations, wherein the plurality of denominations is based on the one or more points; and processing at least one transaction with at least one participant merchant based on an exchange of the virtual currency against at least one object, wherein the exchange of the currency against the at least one object is done between the at least one participant and the at least one participant merchant.

11. The system of claim 8, wherein the communication device is further configured for receiving at least one additional game data from the at least one additional game sensor, wherein the at least one additional game sensor is configured to generate the at least one additional sensor data, wherein the processing device is further configured for:

analyzing the at least one additional game data and the game data; and predicting the occurrence of the betting event based on the analyzing.

12. The system of claim 8, wherein the at least one participant device comprises at least one companion application associated with the at least one game, wherein the at least one companion application present at least one game information associated with the at least one game, wherein the at least one companion application configured for performing:

transmitting the plurality of options associated with the outcome of the betting event to the at least one participant device; and receiving the option indication corresponding the option from the at least one participant device.

13. The system of claim 8, wherein the at least one participant device comprises at least one broadcast receiver associated with the at least one game, wherein the at least one broadcast receiver is configured for:

transmitting the plurality of options associated with the outcome of the betting event to the at least one participant device; and receiving the option indication corresponding the option from the at least one participant device.

14. The system of claim 8, wherein the storage device is further configured for retrieving at least one statistical data associated with the at least one game from a database, wherein the database comprises the at least one statistical data, wherein the processing device is further configured for:

analyzing the at least one statistical data and the game data using machine learning; and generating betting odd data corresponding to the betting event based on the analyzing, wherein the communication device is further configured for transmitting the betting odd data to the at least one participant device.

* * * * *